US010964992B2

(12) United States Patent
Dogiamis et al.

(10) Patent No.: US 10,964,992 B2
(45) Date of Patent: Mar. 30, 2021

(54) ELECTROMAGNETIC WAVE LAUNCHER INCLUDING AN ELECTROMAGNETIC WAVEGUIDE, WHEREIN A MILLIMETER WAVE SIGNAL AND A LOWER FREQUENCY SIGNAL ARE RESPECTIVELY LAUNCHED AT DIFFERENT PORTIONS OF THE WAVEGUIDE

(71) Applicant: Intel Corporation, Santa Clara, CA (US)

(72) Inventors: Georgios Dogiamis, Chandler, AZ (US); Adel A. Elsherbini, Chandler, AZ (US); Henning Braunisch, Phoenix, AZ (US); Gilbert W. Dewey, Beaverton, OR (US); Telesphor Kamgaing, Chandler, AZ (US); Hyung-Jin Lee, Portland, OR (US); Johanna M. Swan, Scottsdale, AZ (US)

(73) Assignee: Intel Corporation, Santa Clara, CA (US)

( * ) Notice: Subject to any disclaimer, the term of this patent is extended or adjusted under 35 U.S.C. 154(b) by 83 days.

(21) Appl. No.: 16/186,103

(22) Filed: Nov. 9, 2018

(65) Prior Publication Data

US 2019/0097293 A1 Mar. 28, 2019

(51) Int. Cl.

| | |
|---|---|
| ***H01P 1/213*** | (2006.01) |
| ***H01P 3/127*** | (2006.01) |
| ***H01P 5/103*** | (2006.01) |
| ***H01P 3/10*** | (2006.01) |
| ***H01P 3/16*** | (2006.01) |
| ***H01P 5/107*** | (2006.01) |
| ***H01P 3/12*** | (2006.01) |
| ***H01P 5/08*** | (2006.01) |

(52) U.S. Cl.

CPC ..... *H01P 1/213* (2013.01); *H01P 1/2131* (2013.01); *H01P 1/2138* (2013.01); *H01P 3/10* (2013.01); *H01P 3/122* (2013.01); *H01P 3/127* (2013.01); *H01P 3/16* (2013.01); *H01P 5/087* (2013.01); *H01P 5/103* (2013.01); *H01P 5/107* (2013.01)

(58) Field of Classification Search

CPC ..... H01P 1/2131; H01P 1/2138; H01P 1/213; H01P 3/16; H01P 5/087

USPC ..... 333/239, 248, 21 A, 137

See application file for complete search history.

(56) References Cited

U.S. PATENT DOCUMENTS

| | | | | |
|---|---|---|---|---|
| 3,508,277 | A * | 4/1970 | Ware et al. | H01Q 13/08 343/776 |
| 4,216,449 | A * | 8/1980 | Kach | H01P 3/16 333/236 |
| 7,078,985 | B2 * | 7/2006 | Guguen et al. | H01P 1/2131 333/135 |
| 2013/0265733 | A1 * | 10/2013 | Herbsommer et al. | H01P 3/16 361/774 |

(Continued)

*Primary Examiner* — Benny T Lee

(74) *Attorney, Agent, or Firm* — Patent Capital Group

(57) ABSTRACT

There is disclosed in one example an electromagnetic wave launcher apparatus, including: an interface to an electromagnetic waveguide; a first launcher configured to launch a high-frequency electromagnetic signal onto a first cross-sectional portion of the waveguide; and a second launcher configured to launch a lower-frequency electromagnetic signal onto a second cross-sectional portion of the waveguide.

20 Claims, 17 Drawing Sheets

(56) References Cited

U.S. PATENT DOCUMENTS

| | | | | |
|---|---|---|---|---|
| 2014/0368301 | A1* | 12/2014 | Herbsommer et al. ... | H01P 3/16<br>333/239 |
| 2015/0295307 | A1* | 10/2015 | Cook et al. ..... | H01Q 1/40<br>343/812 |
| 2017/0170538 | A1* | 6/2017 | Morgan et al. ..... | H01P 3/16 |

* cited by examiner

ELECTROMAGNETIC WAVE LAUNCHER INCLUDING AN ELECTROMAGNETIC WAVEGUIDE, WHEREIN A MILLIMETER WAVE SIGNAL AND A LOWER FREQUENCY SIGNAL ARE RESPECTIVELY LAUNCHED AT DIFFERENT PORTIONS OF THE WAVEGUIDE

FIELD OF THE SPECIFICATION

This disclosure relates in general to the field of millimeter wave communication, and more particularly, though not exclusively, to a system for providing a multiband waveguide interconnect.

BACKGROUND

Interconnects provide communication between computing elements in a computing system.

BRIEF DESCRIPTION OF THE DRAWINGS

The present disclosure is best understood from the following detailed description when read with the accompanying FIGURES. It is emphasized that, in accordance with the standard practice in the industry, various features are not necessarily drawn to scale, and are used for illustration purposes only. Where a scale is shown, explicitly or implicitly, it provides only one illustrative example. In other embodiments, the dimensions of the various features may be arbitrarily increased or reduced for clarity of discussion.

DETAILED DESCRIPTION OF THE EMBODIMENTS

Figure 1:
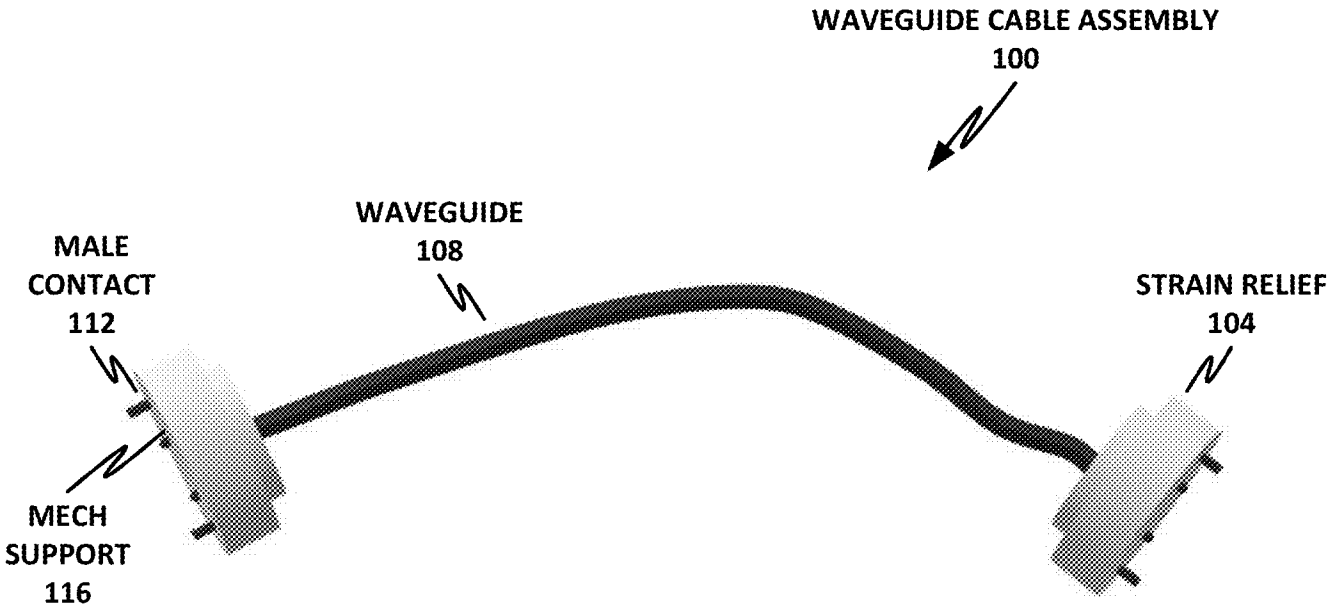
FIG. 1 is a perspective view of a waveguide cable assembly.

The following disclosure provides many different embodiments, or examples, for implementing different features of the present disclosure. Specific examples of components and arrangements are described below to simplify the present disclosure. These are, of course, merely examples and are not intended to be limiting. Further, the present disclosure may repeat reference numerals and/or letters in the various examples, or in some cases across different FIGURES. This repetition is for the purpose of simplicity and clarity and does not in itself dictate a specific relationship between the various embodiments and/or configurations discussed. Different embodiments may have different advantages, and no particular advantage is necessarily required of any embodiment.

A contemporary computing platform may include a complex and multi-faceted hardware platform provided by Intel®, another vendor, or combinations of different hardware from different vendors. For example, in a large data center such as may be provided by a cloud service provider (CSP) or a high-performance computing (HPC) cluster, the hardware platform may include rack-mounted servers with compute resources such as processors, memory, storage pools, accelerators, and other similar resources. As used herein, "cloud computing" includes network-connected computing resources and technology that enables ubiquitous (often worldwide) access to data, resources, and/or technology. Cloud resources are generally characterized by flexibility to dynamically assign resources according to current workloads and needs. This can be accomplished, for example, by assigning a compute workload to a guest device, wherein resources such as hardware, storage, and networks are provided to a virtual machine, container, or disaggregated node by way of nonlimiting example.

In embodiments of the present disclosure, a processor may include any programmable logic device with an instruction set. Processors may be real or virtualized, local or remote, or in any other configuration. A processor may include, by way of nonlimiting example, an Intel® processor (e.g., Xeon®, Core™, Pentium®, Atom®, Celeron®, x86, or others). A processor may also include competing processors, such as processors provided by Advanced Micro Devices (e.g., Kx-series x86 workalikes, or Athlon, Opteron, or Epyc-series Xeon workalikes), Advanced RISC Machines processors, and Power ISA and PowerPC processors provided by International Business Machines, to name just a few.

Interconnects are an important part of any integrated computer system that requires communication. In most cases, the speed and bandwidth of an interconnect technology represent a limiting factor of the speed of the system as a whole. A majority of computing systems can process data more quickly internally than they can communicate the data to an outside system. This is true both within the chassis (e.g., a direct memory access (DMA) bus, or a Northbridge or a Southbridge) and between computing devices (e.g., within a network).

As more computing moves to the data center, network demands increase. For example, many existing data centers have interconnects that operate in the 10 to 50 gigabit per second (Gbps) range. However, following a pattern similar to "Moore's Law," the required speeds in the data center are expected to double past 100 Gbps by 2020, and then continue to double every few years thereafter. Increasing network speeds to handle the ever-increasing data demands on the data center introduces design complexities. These design complexities increase as users consume more and more data, and as more and more data are stored remotely from the devices that are consuming them (e.g., in "clouds").

In cloud data centers, enterprise data centers, and other computing architectures that rely heavily on computer interconnects (such as HPC architectures), there may be multiple levels of interconnects between the various electronic devices hosted in a cluster. The various levels of interconnects can include, by way of illustrative and nonlimiting example, connections within a blade, connections within a rack, rack-to-rack connections, rack-to-switch connections, and switch-to-switch connections.

Traditionally, the longer interconnects (such as rack-to-switch and switch-to-switch) are provided via very high speed fiber optic interconnects. The speed of these interconnects is limited only by the speed of modulating data on light pulses and by the propagation delay through the fiber optic cable. While this provides very high speed communication, fiber optic interconnects are generally more expensive and less power efficient than other interconnects.

Shorter interconnects, such as those within the rack in some rack-to-rack communications, can be implemented with electrical cables such as Ethernet cables, coaxial cables, twinaxial cables, and similar. The selection of a cable may depend on the desired data rate.

As higher performance architectures are required, these traditional electrical cabling approaches may be inadequate to support the required data rates while satisfying the required interconnect distance. In cases where they can be modified to support the required data rates, such cabling approaches become expensive, power-inefficient and may introduce additional latency. For example, the operational length and speed of an electrical cable can be extended by using higher quality materials, active re-driving and re-timing circuits, and advanced techniques such as forward error correction (FEC). While these techniques can effectively increase the speed and length of electrical links, they lead to increased latency, power consumption and eventually increase the total interconnect cost.

Alternatively, a proposed solution to the challenges presented by traditional electrical cabling is the operation at millimeter-wave bands, up to sub-terahertz (THz) frequency bands, which range from tens of gigahertz (GHz) to hundreds of GHz, specifically 30 GHz to 900 GHz. In these frequency bands, waveguides provide a practical solution that is lower cost than optical cabling, while yielding higher speeds than traditional electrical interconnects.

Traditional rectangular metallic waveguides provide very high theoretical performance, but they are inflexible and heavy, and thus are not practical as cabling. Lower weight and greater flexibility can be realized by providing a dielectric waveguide (DWG). A dielectric waveguide could be as simple as a conductive foil in a cylindrical form factor, which has only air filling the waveguide. However, such waveguides can be prone to kinking and can be very fragile. Thus, a more common design is a cylindrical or rectangular waveguide that shares some attributes with traditional coaxial cables. The waveguide may have an external coating, or jacket to provide protection and comply with environmental and electromagnetic interference requirements. This could be, for example, polyvinyl chloride (PVC) or other flexible material combined with metallic braiding. Within this is a conductive foil, such as copper, aluminum, or other conductive material. This houses a dielectric which provides the actual dielectric medium for the propagating high-frequency electromagnetic (EM) wave. In some cases, the dielectric material also has a layer of cladding around it, which further provides structural support and protection. The cladding could be, for example, a foam or other dielectric material. The inner core of the dielectric-clad waveguide is typically a material with a higher dielectric constant than the cladding. An EM wave launcher drives signals into the dielectric medium, and the EM wave is then received at the other end of the connection by a receiving EM wave launcher.

Millimeter waveguide communication offers substantial advantages in terms of bandwidth density and transmission distance, as compared to standard copper or other electrical interconnects. Advantageously, waveguides do not require complex integration of active and passive optical components as is required in optical communications and are at least an order of magnitude more tolerant to assembly misalignment. Thus, millimeter waveguides offer a useful "middle ground" between the highest-speed fiber optic interconnects and available electrical interconnects.

Waveguides do, however, encounter substantial challenges. One challenge is in the transmission of very high frequencies (e.g., between approximately 300 GHz and up to 1 THz). Standard waveguides, with a dielectric waveguide and a conductive coating become very lossy at high frequencies, on the order of 15 to 20 decibels (dB) per meter or more. This can significantly impact the overall link budget and the energy efficiency of the communication (measured, for example, in picojoules per bit). In designing a functional waveguide, it is desirable to have losses more on the order of 1 to 5 dB per meter or less.

Much lower loss can be realized by removing the conductive shielding around the dielectric waveguide. However, removal of the conductive shielding may also have some disadvantages. An unshielded waveguide supports propagation of hybrid mode EM waves and has much lower losses, on the order of less than 5 dB per meter at frequencies below 1 THz. In this transmission mode, however, much of the power of the signal is propagated around the edges of the waveguide medium. This can render the waveguide more susceptible to interference, and can result in crosstalk between neighboring and closely-spaced waveguides.

One solution to reduce crosstalk or interference with the propagating EM wave is to introduce a further dielectric cladding around the dielectric core of the waveguide. The cladding size may be approximately two to three times the maximum wavelength of the signal being propagated through the waveguide. While this addresses the crosstalk challenge, it also substantially increases the waveguide cross-section by adding a bulky dielectric cladding around the transmission medium. This affects the overall bandwidth density of the proposed interconnect.

Accounting for the cladding, the effective bandwidth density of the overall cable is much reduced. However, bandwidth density can be substantially increased by using the cladding itself as a secondary transmission medium. Note that the cladding itself is often a dielectric medium. In these examples, the inner "core" transmission medium may be a high relative permittivity (high $\varepsilon_r$, or in other words, high dielectric constant) material, while the cladding may be a low relative permittivity (low $\varepsilon_r$) material. The core transmission medium with high permittivity can be used to transmit very high-frequency signals, such as on the order of 300 GHz to 1 THz. The low permittivity cladding may not support such high-frequency transmissions, though it may support transmissions more on the order of 50 to 200 GHz. However, the combination of the high-frequency core medium and the lower-frequency cladding can be used together to increase the overall bandwidth density of the cable. Unlike some existing cables with cladding around the dielectric transition medium, a cable designed according to the present specification may have an inner core with cladding, with an additional conductive shield around the cladding. This conductive shield provides shielding for the cladding, which itself acts as a transition medium for a lower-frequency signal. Because the cladding is not expected to handle frequencies as high as the inner core, the issue of transmission loss through the cladding is less substantial. The cladding may be approximately two to three wavelengths in diameter, relative to the high-permittivity core. Because the electric field of the signal propagated through the high-permittivity core extends substantially approximately one wavelength outside the boundary of the inner core, the conductive shielding will not affect the EM wave propagation inside the high-permittivity core, and hence will not cause substantial transmission line loss for the high-permittivity core.

Other embodiments are also contemplated in which the high-permittivity "core" is not necessarily substantially concentric with the shielding and the cladding. For example, in one embodiment, the high-permittivity core is actually located near one of the edges of the cladding. This arrangement can realize advantages as discussed below.

Another embodiment contemplates a plurality of high-permittivity cores within a single cladding, wherein each of the high-permittivity cores can be used as a waveguide, and the cladding itself can also be used as a waveguide. Additional embodiments are contemplated that are consistent with the teachings of the present specification.

A system and method for providing a multiband waveguide interconnect will now be described with more particular reference to the attached FIGURES. It should be noted that throughout the FIGURES, certain reference numerals may be repeated to indicate that a particular device or block is wholly or substantially consistent across the FIGURES. This is not, however, intended to imply any particular relationship between the various embodiments disclosed. In certain examples, a genus of elements may be referred to by a particular reference numeral ("widget 10"), while individual species or examples of the genus may be referred to by a hyphenated numeral ("first specific widget 10-1" and "second specific widget 10-2").

FIG. 1 is a perspective view of a waveguide cable assembly 100. The general principles of waveguides are well-known. Waveguides can be contrasted with electrical conductors, which have field components in the transverse direction referred to as transverse electromagnetic modes (TEM). In contrast, a waveguide has a single hollow conductor and in some cases there may not be any conductor present. Waveguides can be designed to support transverse magnetic (TM), transverse electric (TE), TEM, or hybrid EM modes. The waveguides described in this specification generally include a dielectric propagation medium that optionally may be surrounded by a conductive shield.

Waveguide cable assembly 100 is illustrated as a high-level connector, and can represent several different kinds of waveguides, including a waveguide bundle.

A simple waveguide is a metallic rectangular waveguide. In the case of a metallic rectangular waveguide, a dielectric ribbon or round core is metal-coated and connectorized at both ends with strain relief 104, along with mechanical (MECH) supports 116 and, optionally, male contacts 112. Note that male contacts 112 do not necessarily interface to electric circuitry for electrical transmission. Rather, mechanical supports 116 and male contacts 112 may provide a mechanical and structural guide to ensure that waveguide cable assembly 100 interfaces properly to launchers in the waveguide network card. In the case of waveguide cable assembly 100, it is sufficient for the dielectric transmission medium to physically interface to the launcher, thus ensuring that when an electromagnetic wave is launched onto waveguide 108, the electromagnetic wave propagates into the correct dielectric medium.

In the case where waveguide cable assembly 100 employs a metallic rectangular waveguide, the waveguide may operate with relatively low losses up to 200 GHz. But as frequencies increase beyond the 300 GHz range and up to approximately 1 THz, the system becomes much lossier, with losses much greater than 15 dB per meter. This can impact the link budget and the energy efficiency of a millimeter-wave or sub-terahertz transceiver.

To reduce losses over length, the waveguide cable assembly 100 could be constructed with only a dielectric propagation medium and without the conductive shielding. This may be referred to as a dielectric-only waveguide. Known dielectric waveguides have much lower losses at the 300 GHz to 1 THz range, with losses generally in the range of 1 to 5 dB per meter. While such waveguides experience less loss, such waveguides may require relatively large cladding around the waveguide core, with a diameter of 2 to 4 times the core radius (assuming, for example, a round waveguide). Because some of the electromagnetic wave power lies beyond or outside of the core dielectric material, an uncladded waveguide would be subject to interference simply by touching the uncladded waveguide or by placing the uncladded waveguide next to another waveguide within the same bundle. However, with the cladding, the effective bandwidth density of the overall cable is reduced.

Other embodiments of waveguide cable assembly 100 may include a metallic-coated, multi-material and multi-mode waveguide that can be utilized to increase bandwidth density, and/or for asymmetric full-duplex operation. This configuration increases the effective bandwidth density because the multi-mode waveguide uses the cladding itself as a secondary transmission medium. This approach also allows for full-duplex operation. Embodiments of such a waveguide are described throughout the remainder of this specification.

Figure 2:
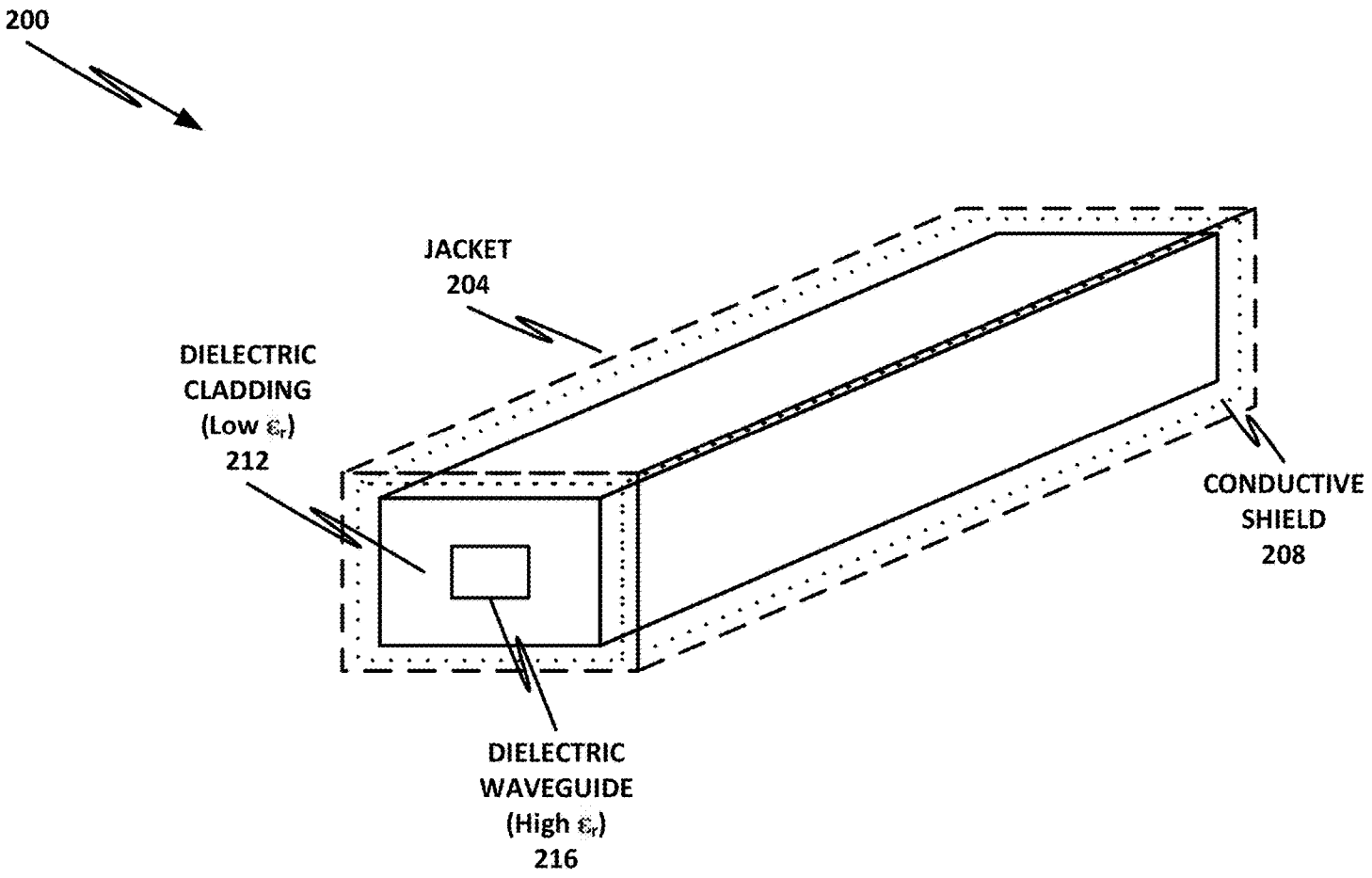
FIG. 2 is a perspective view of selected elements of a waveguide.

FIG. 2 is a perspective view of selected elements of a waveguide 200. Waveguide 200 may be configured for propagation of signals through both the core dielectric waveguide 216 and through dielectric cladding 212. By way of illustrative example, dielectric waveguide 216 may have a high relative permittivity $\varepsilon_r$ of approximately 3 to 20, while dielectric cladding 212 may have a low relative permittivity $\varepsilon_r$ down to about 1.5 or 1.6. Note that in this embodiment, there is no conductive shielding directly around dielectric waveguide 216. The lack of conductive shielding around dielectric waveguide 216 helps to reduce transmission losses such that the losses through dielectric waveguide 216 are on the order of 1 to 5 dB per meter, instead of 15 to 20 or more dB per meter, at frequency ranges of approximately 300 GHz to 1 THz.

Dielectric cladding 212 can also be used for signal propagation, according to the teachings of the present specification. Dielectric cladding 212 has a lower $\varepsilon_r$ than dielectric waveguide 216, such as on the order of 1.5 or 1.6. Although dielectric cladding 212 may not support propagation of signals as high in frequency as dielectric waveguide 216, lower-frequency signals can be propagated through dielectric cladding 212. For example, signals with a frequency of 50 to 200 GHz can propagate through dielectric cladding 212. At such frequencies conductive losses can still be tolerated and hence the dielectric cladding 212 can be surrounded by a conductive shield 208. Finally, the entire assembly can have a nonconductive jacket 204, such as PVC or other covering material that provides some physical protection, and also cosmetic benefits, to add to waveguide 200. Optional additional shielding below the jacket 204 to conform to EM interference requirements or enable power-over-cable may be employed in the form of a conductive braid or conductive foil. By using both cladding 212 and waveguide 216 for signal propagation, the overall bandwidth density of waveguide 200 is increased.

In a more generalized case, dielectric waveguide 216 may serve as a transmission medium for greater than 200 GHz EM waves, while cladding material 212 may serve as a transmission medium for less than 200 GHz EM waves.

In this illustration, dielectric waveguide 216 is shown concentric with, and in the middle of, dielectric cladding 212. This configuration is shown in FIG. 3.

Figure 3:
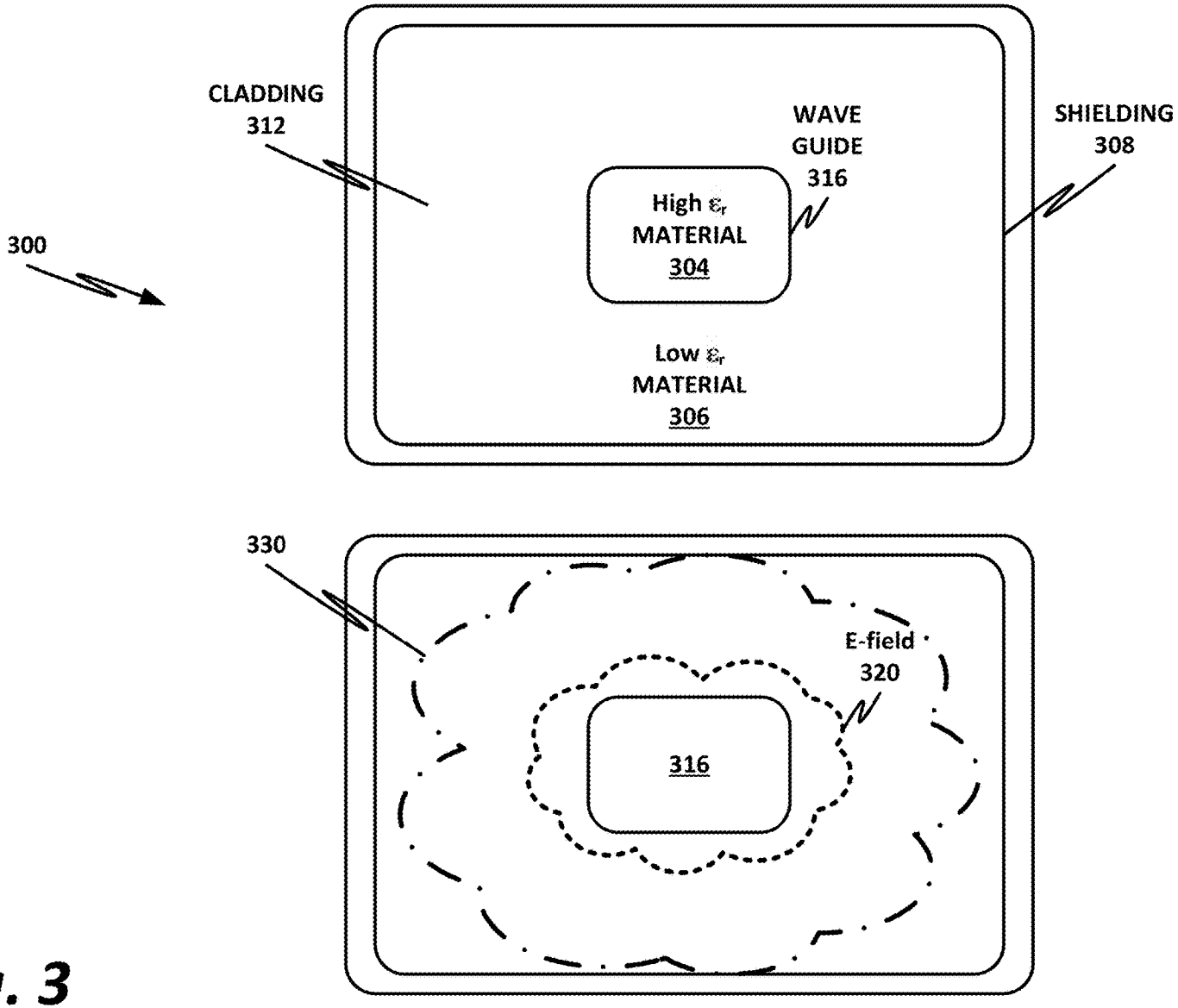
FIG. 3 is a cutaway front view of embodiments of a waveguide.

FIG. 3 is a cutaway front view of a waveguide 300, which may be an embodiment of or a different waveguide from waveguide 200 of FIG. 2. As illustrated in FIG. 3, waveguide 316 is constructed of a high $\varepsilon_r$ material 304, while cladding 312 is constructed of a low $\varepsilon_r$ material 306. Waveguide 316 does not have any conductive shielding directly around it, but cladding 312 can have shielding 308 around it.

Launchers may be configured to form electric fields 320 and 330 within material 304 and 306, respectively. Note that the launchers may be configured to be orthogonal to one another, so that E-field 320 is orthogonal to E-field 330. Note that E-field 320 may extend approximately one λ (one wavelength) outside of waveguide 316. E-field 330 can be launched essentially over the top of E-field 320. This can be done as a practical matter in part because the fields are orthogonal to one another, and are operating at different frequencies and EM modes. However, there is some danger of multimode propagation (e.g., the signal from waveguide 316 could propagate in a higher-order mode along with the lower-frequency signal propagating in the material 306 (E-field 330)).

Figure 4:
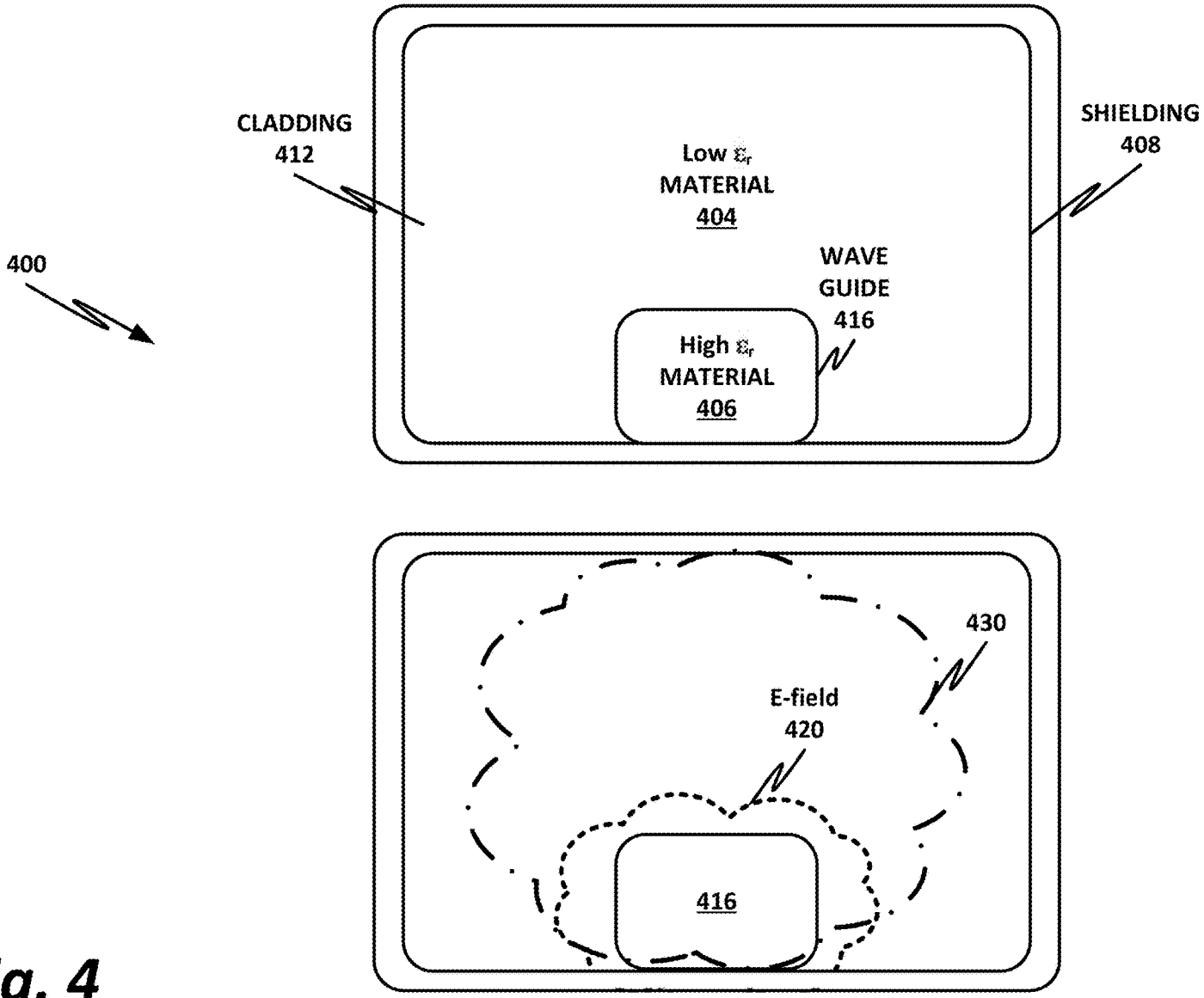
FIG. 4 illustrates an embodiment of a multimode waveguide.

FIG. 4 illustrates an embodiment of a multimode waveguide 400. Multimode waveguide 400 is substantially similar to waveguide 300 of FIG. 3, including a waveguide 416 made of high $\varepsilon_r$ material 406, and cladding 412 made of low $\varepsilon_r$ material 404. Cladding 412 is shielded by conductive shielding 408.

In this example, instead of having waveguide 416 concentric with and in the center of cladding 412, waveguide 416 is disposed at or near an edge of cladding 412. Orienting waveguide 416 in this manner can result in a simplified cable construction.

As in FIG. 3, two E-fields 420 and 430 exist in FIG. 4 when signals are launched onto the two dielectric materials. In this case, E-field 420 exists near the bottom of cladding 412, and this spatial orientation provides an opportunity for greater isolation between E-field 420 and E-field 430. Again, the two E-fields may be launched substantially orthogonal to one another, and again, E-field 420 extends substantially approximately one A outside of waveguide 416. However, as before, there is a possibility of multimode propagation.

The sizes of respective waveguide 316 and waveguide 416 and corresponding cladding 312 and 412 may be selected according to operational characteristics such as the desired frequency of the system. By way of illustrative and nonlimiting example, dimensions for waveguide 316 and 416 may be approximately 0.1-1 millimeter (mm) length and width, while cladding 412 may have length and width of approximately 1 to 5 mm. This is assuming a substantially square shape for both cladding 312/412 and waveguide 316/416. Note that other rectangular shapes are possible, in which case one dimension may be of the sizes previously mentioned, or other shapes, such as round, elliptical, H-shaped, hollow, or others. Again, in each of these cases, at least one of the dimensions of the shape may be of the sizes selected. In general, when other operating frequencies are selected, the sizes of waveguide 416 and cladding 412 may be selected as appropriate for those frequencies.

In one specific example, waveguide 316/416 is rectangular, with dimensions of approximately 200 micrometers (μm)×400 μm or less for greater than 200 GHz operation. Cladding 412 may have dimensions of 1.5 mm×3 mm or less for approximately 50 GHz operation, or operation between 50 GHz and 200 GHz.

Also note that in the embodiment of FIG. 4, shielding 408 runs substantially along one edge of waveguide 416. In this case, the system uses ground cladding as an image plane, and the waveguide height may be reduced by half. In other words, rather than being 200 μm×400 μm, waveguide 416 may be approximately 100 μm×400 μm. Note that all of these embodiments are shown by illustrative example only, and other embodiments are possible, including an embodiment wherein a 200 μm×400 μm waveguide is used in multimode waveguide 416, or a 100 μm×400 μm waveguide is used in waveguide 316.

Also note that, as is shown for example in FIG. 10, multiple high $\varepsilon_r$ waveguides may be present in the system.

Figure 5:
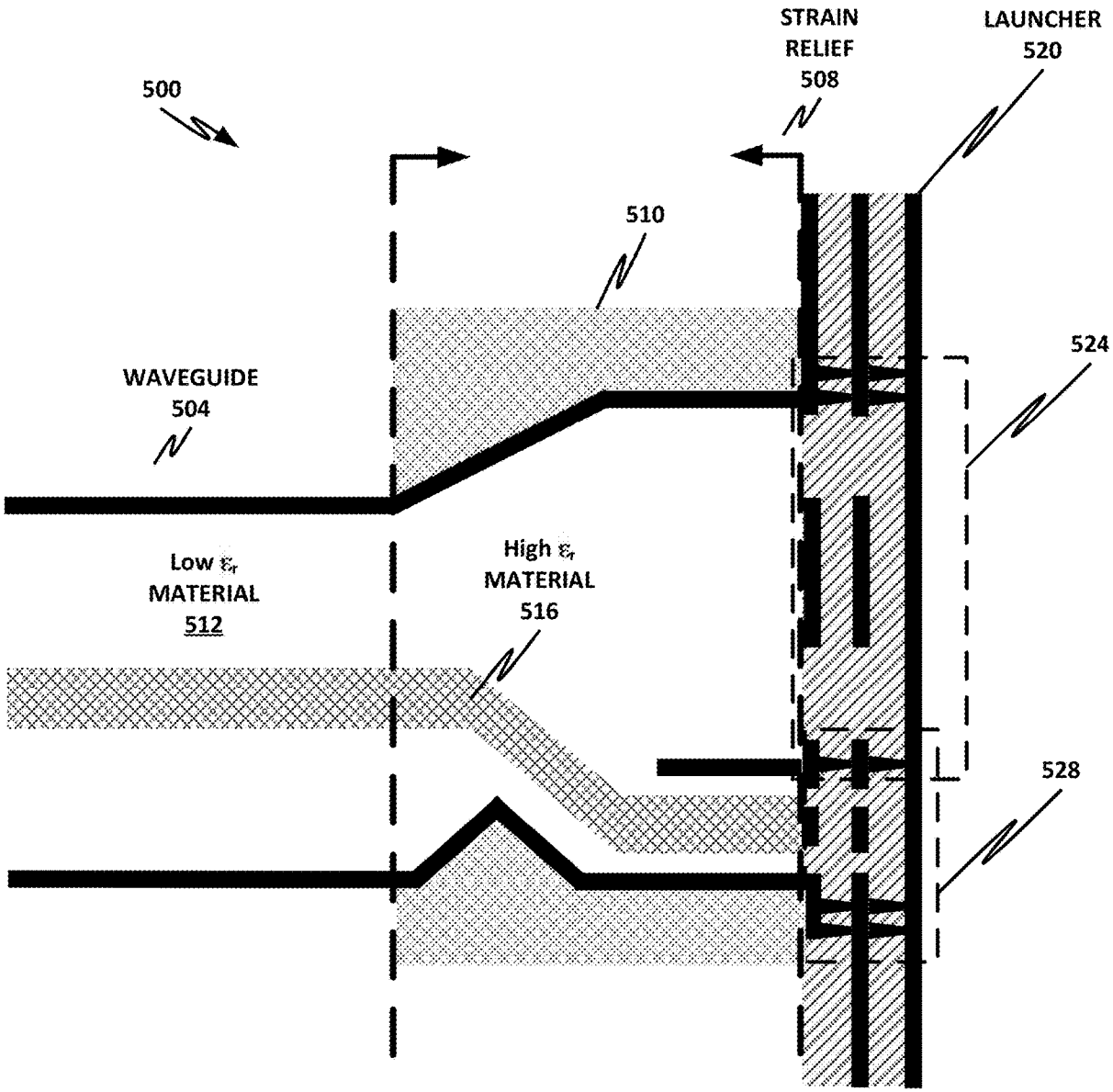
FIG. 5 is a cutaway side view of a launcher mechanism.

FIG. 5 is a cutaway side view of a launcher mechanism 500. One concern with waveguides such as those illustrated herein is the potential of multimode propagation. At any impedance discontinuity, higher-order modes may be generated and propagated causing multimode dispersion.

Multimode propagation for each waveguide may be minimized by ensuring that only one mode is launched from the electromagnetic launcher into the waveguide cable assembly. During operation, waveguide cables may further need to comply with minimum bending radius specifications.

In an active cable configuration, the connector, launcher, and active circuitry are all part of the active cable housing. Because it is assumed that there is no coupling or decoupling of the waveguide from the housing during operation, the waveguide can be codesigned with the connector and the launcher to achieve single mode signal launching at the connector level. As discussed above, designing a single launcher for launching both high and low-frequency components, while having very high isolation between the two and only launching a single mode, can be challenging.

Another way to achieve single mode operation is to launch the signals at different locations along the cable. However, achieving this can be challenging, as well. In the embodiment illustrated in FIG. 5, the connector is designed to guide the two waves on two different launchers and to ensure no multimode generation and propagation. The first (high-frequency) launcher and second (low-frequency) launcher may be co-located on a single network card. Note that the embodiments illustrated in FIGS. 5, 6, 7, 8, and 9 use patch launchers, but other launchers are also possible, such as dipole launchers, tapered-slot/Vivaldi launchers, and others.

Figure 7:
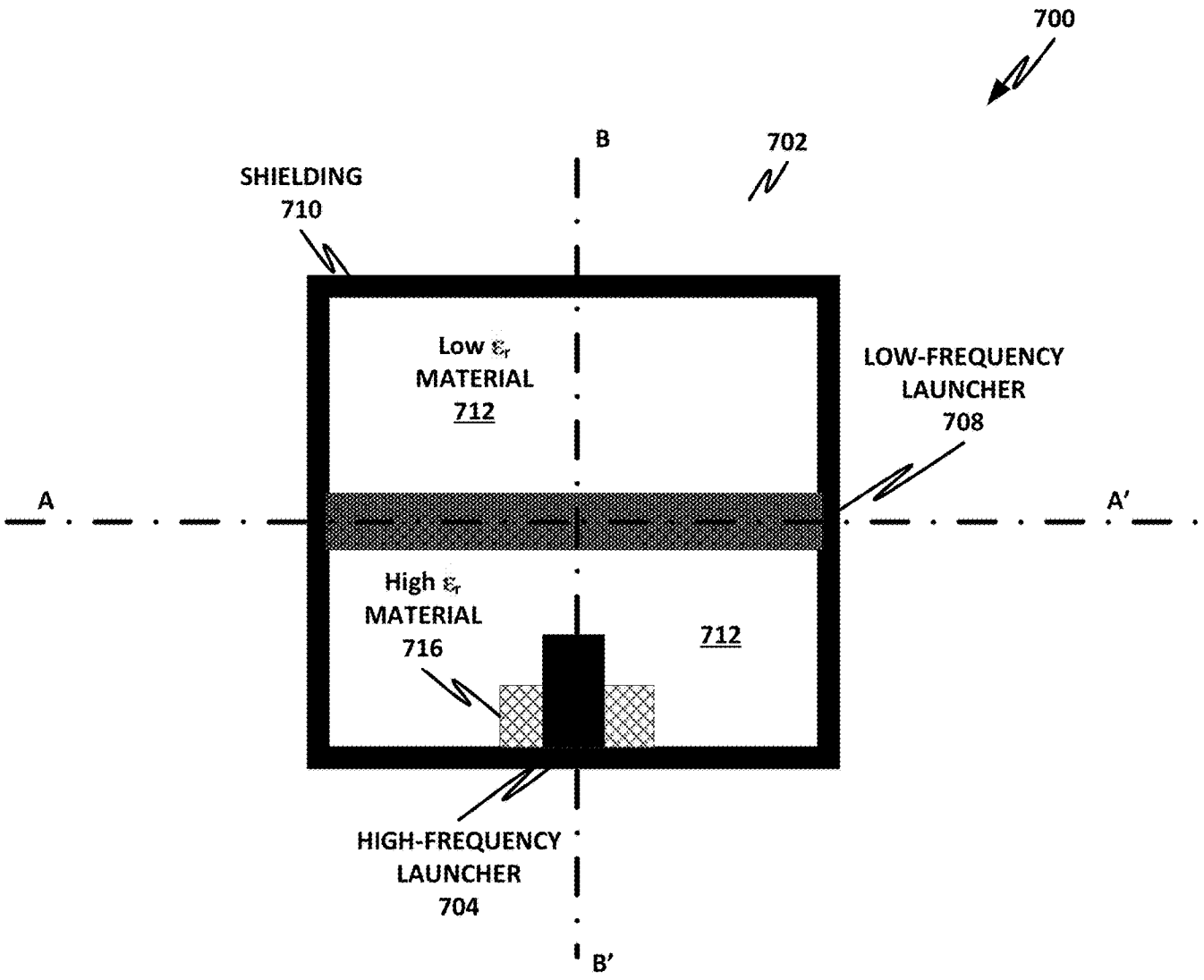
FIG. 7 illustrates an embodiment of a launching system.
Figure 8:
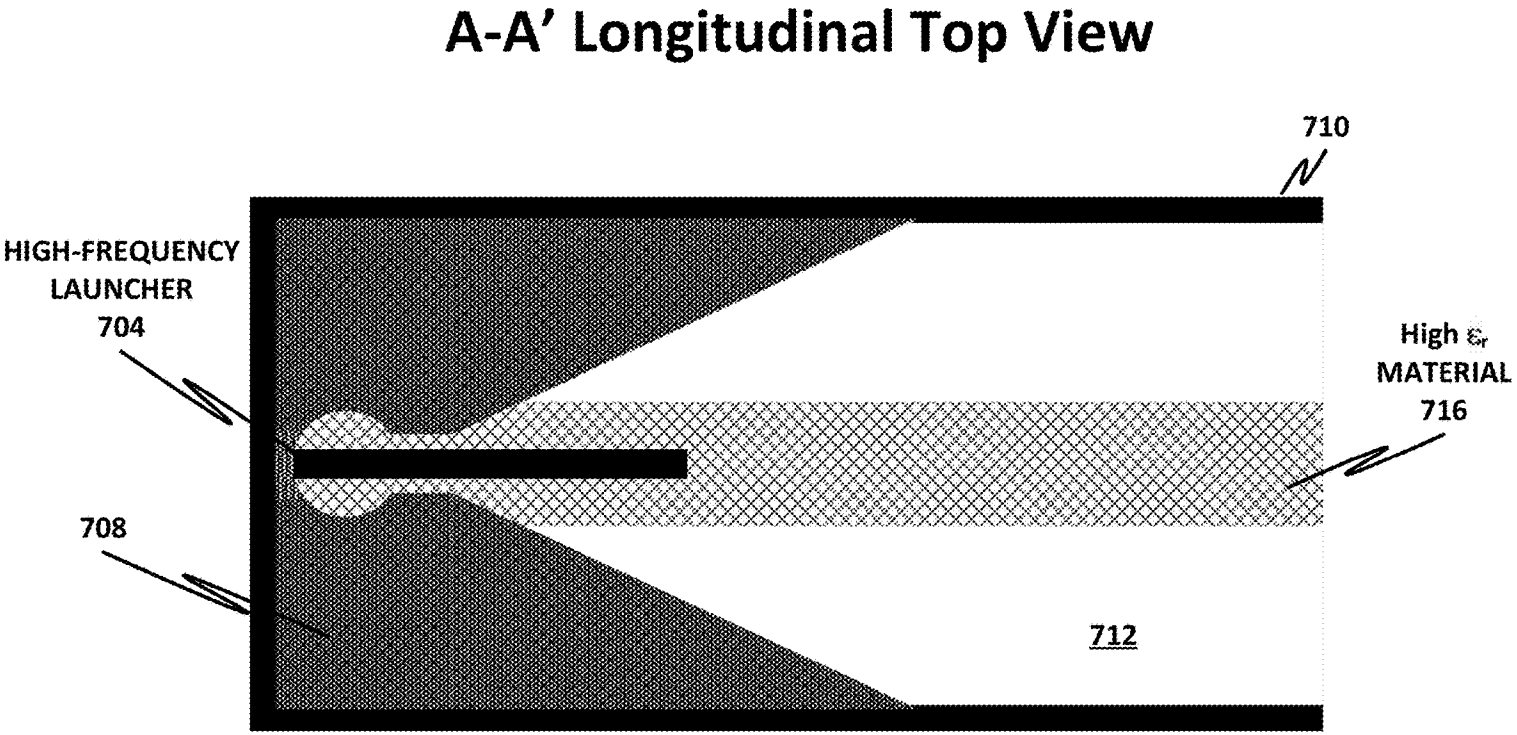
FIG. 8 is a cutaway top view of a waveguide.
Figure 9:
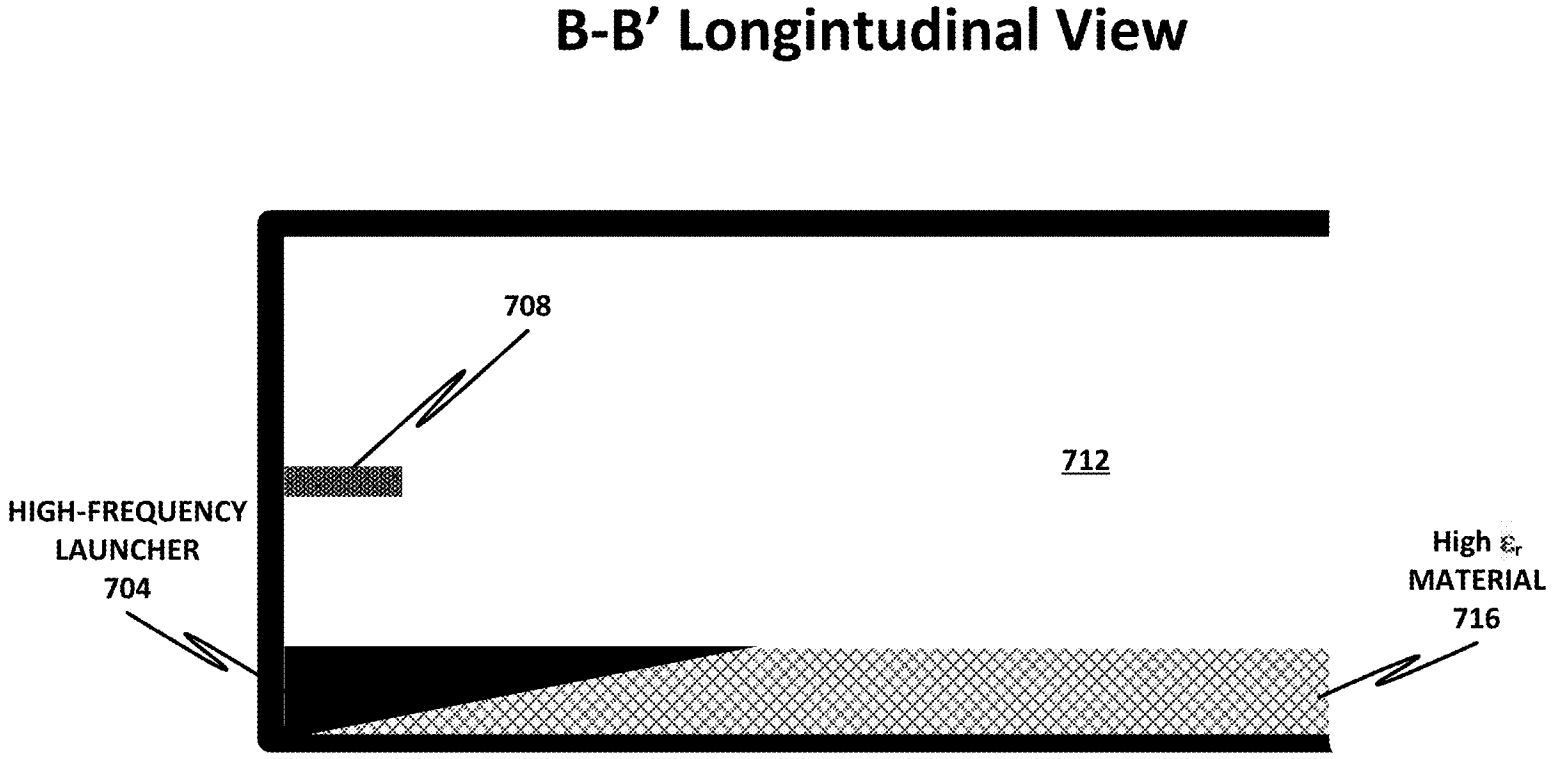
FIG. 9 illustrates a further view of a waveguide.

As illustrated in FIGS. 7, 8, and 9, different polarizations can also be used to reduce multimode propagation.

Launching system 500 of FIG. 5 is designed to operate with a waveguide such as waveguide 300 of FIG. 3. Launcher 520 includes two launchers, namely high-frequency launcher 528 and low-frequency launcher 524. High-frequency launcher 528 is configured to interface with high $\varepsilon_r$ material 516, while low-frequency launcher 524 is configured to interface with low $\varepsilon_r$ material 512 of waveguide 504.

In this example, waveguide 504 is connectorized via strain relief 508. Strain relief 508 nominally provides mechanical structure for waveguide 504, but also provides a crossover between high $\varepsilon_r$ material 516 and low $\varepsilon_r$ material 512. Because low $\varepsilon_r$ material 512 passes through the center of waveguide 504, it is difficult to launch the signals directly onto the two media. This could be accomplished, but the two launchers would have to be concentric with one another, which could introduce additional design complexities.

In this configuration, instead of having concentric launchers, high-frequency launcher 528 is at the bottom, while low-frequency launcher 524 is at the top. Housing 510 surrounds strain relief 508.

Within strain relief 508, high $\varepsilon_r$ material 516 crosses under and through low $\varepsilon_r$ material 512, so that the two materials are concentric within waveguide 504. This allows launching of the signals via non-concentric launchers 524 and 528.

If a waveguide such as multimode waveguide 400 of FIG. 4 is used, wherein waveguide 416 is not concentric with cladding 412, then a launcher such as launcher system 600 may be used. Launcher system 600 includes launcher 620, having low-frequency launcher 624 and high-frequency launcher 628. As before, strain relief 608 provides structure to waveguide 604, but does not need to provide the more complicated crossover illustrated in FIG. 5. Rather, low-frequency launcher 624 launches a low-frequency signal directly onto low $\varepsilon_r$ material 512, while high-frequency launcher 628 launches a signal directly onto high $\varepsilon_r$ material 516.

This configuration utilizes the image plane concept, wherein the high $\varepsilon_r$ waveguide is moved away from the center and toward an edge of the cladding. This enables physical decoupling of the two launchers (e.g., one for greater than 200 GHz EM spectrum, and the other for less than 100 GHz EM spectrum). In this case, there are two neighboring launchers, namely launcher 624 and launcher 628.

Figure 6:
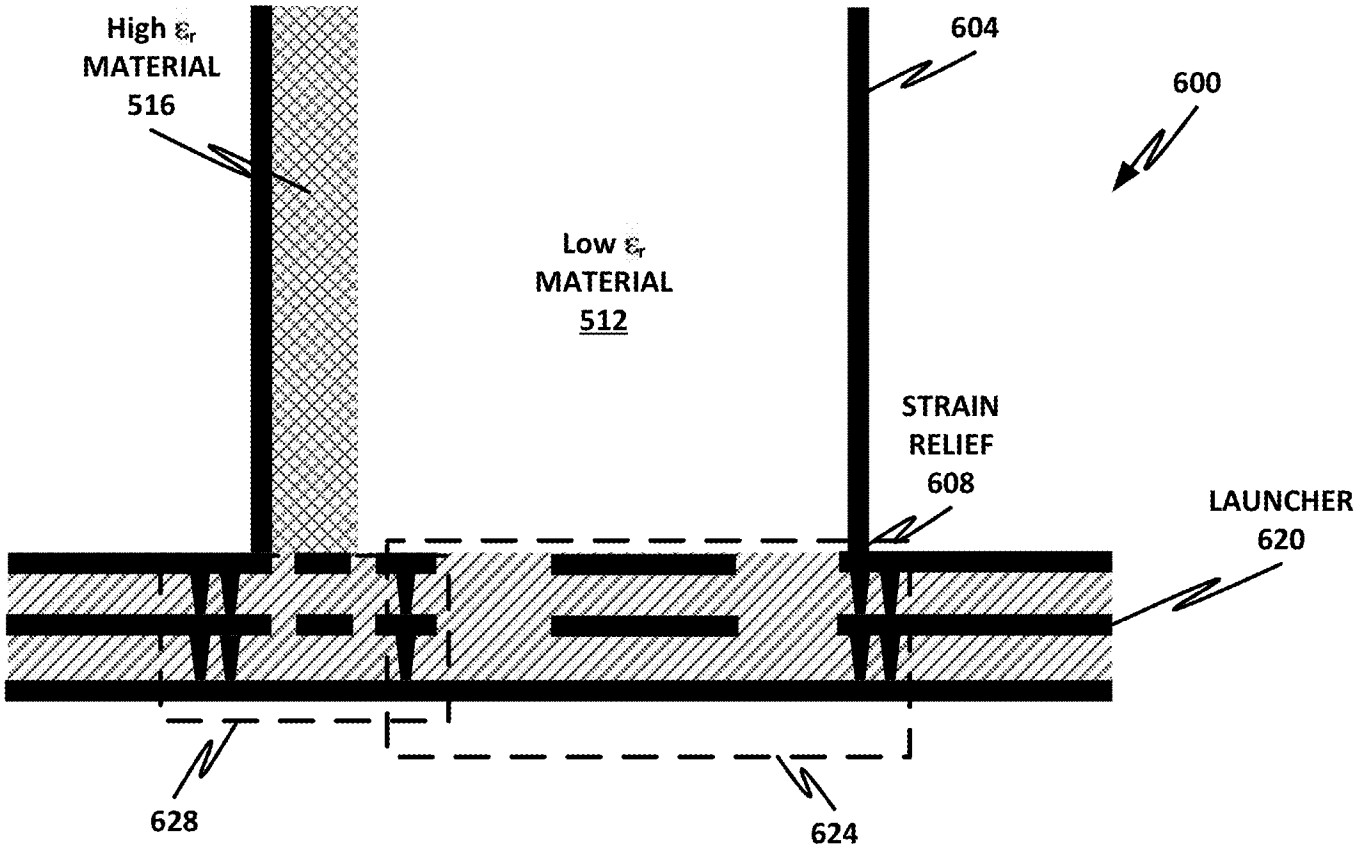
FIG. 6 illustrates a multimode waveguide and stacked-patch waveguide launchers.

The configuration of FIG. 6 shows a multimode waveguide and stacked-patch waveguide launchers, wherein launchers 624 and 628 operate on different frequencies. The low-frequency EM wave cannot propagate into the high-frequency waveguide, providing very low or zero confinement. Thus, the low-frequency EM wave will develop and propagate within the larger low $\varepsilon_r$ material 512.

The high-frequency EM wave is launched into high $\varepsilon_r$ material 516, and by design, higher-order mode generation is suppressed.

Turning to FIG. 7, a launching system 700 is illustrated. System 700 is shown in various views across FIGS. 7, 8, and 9. The polarization illustrated in FIGS. 7, 8, and 9 is compatible with either launching system 500 of FIG. 5 or launching system 600 of FIG. 6. The principles of this illustration can also be applied to other systems.

Launching system 700 utilizes two neighboring launchers, a high-frequency launcher 704 and a low-frequency launcher 708. As in previous embodiments, waveguide 702 includes a high $\varepsilon_r$ material 716 and a low $\varepsilon_r$ material 712, with shielding 710 around low $\varepsilon_r$ material 712. As seen here, low-frequency launcher 708 and high-frequency launcher 704 are configured to be substantially orthogonal to one another. In this case, high-frequency launcher 704 is of substantially vertical polarization, while low-frequency launcher 708 is of substantially horizontal polarization. A cross-section A-A' is provided for further illustration in FIG. 8. Note that the terms "vertical" and "horizontal" are used here for convenience of the illustration. But the terms should be understood broadly to indicate that the launchers have polarizations that are mutually orthogonal, and do not necessarily require an absolute "vertical" or "horizontal" with respect to some absolute horizon.

Turning to FIG. 8, a cutaway longitudinal top view along line A-A' is seen, wherein launcher 704, launcher 708, high $\varepsilon_r$ material 716, low $\varepsilon_r$ material 712, and shielding 710 are all visible. As is further illustrated in this FIGURE, launcher 708 is configured in a horizontal tapered-slot formation, while launcher 704 is configured in a vertical polarization. Additional aspects of launcher 704 are visible in FIG. 9, which is a cutaway longitudinal side view along line B-B' in FIG. 7. Again, launcher 708 is seen in a horizontal polarization, although in this illustration the taper configuration is not visible.

Turning to FIG. 9, it is more easily appreciated that high-frequency launcher 704 can also be in a tapered configuration similar to launcher 708 to launch signals onto high $\varepsilon_r$ material 716. Tapered-slot launchers 704 and 708 are not limited to straight tapers, but can be of any shape such as elliptical, polynomial or stair-case tapers.

Note that in FIGS. 5 through 9, the launchers are illustrated conceptually, but this should not be understood as an implication that they are logically isolated from their supporting electrical components. The launchers illustrated in FIGS. 5 through 9 do not exist in a vacuum, but rather interface with a computing system, such as via a PCIe bus as illustrated in FIGS. 11*a*, 11*b*, and 12 through 15, and may exist in computing architectures as illustrated in FIGS. 16 through 21.

Figure 10A:
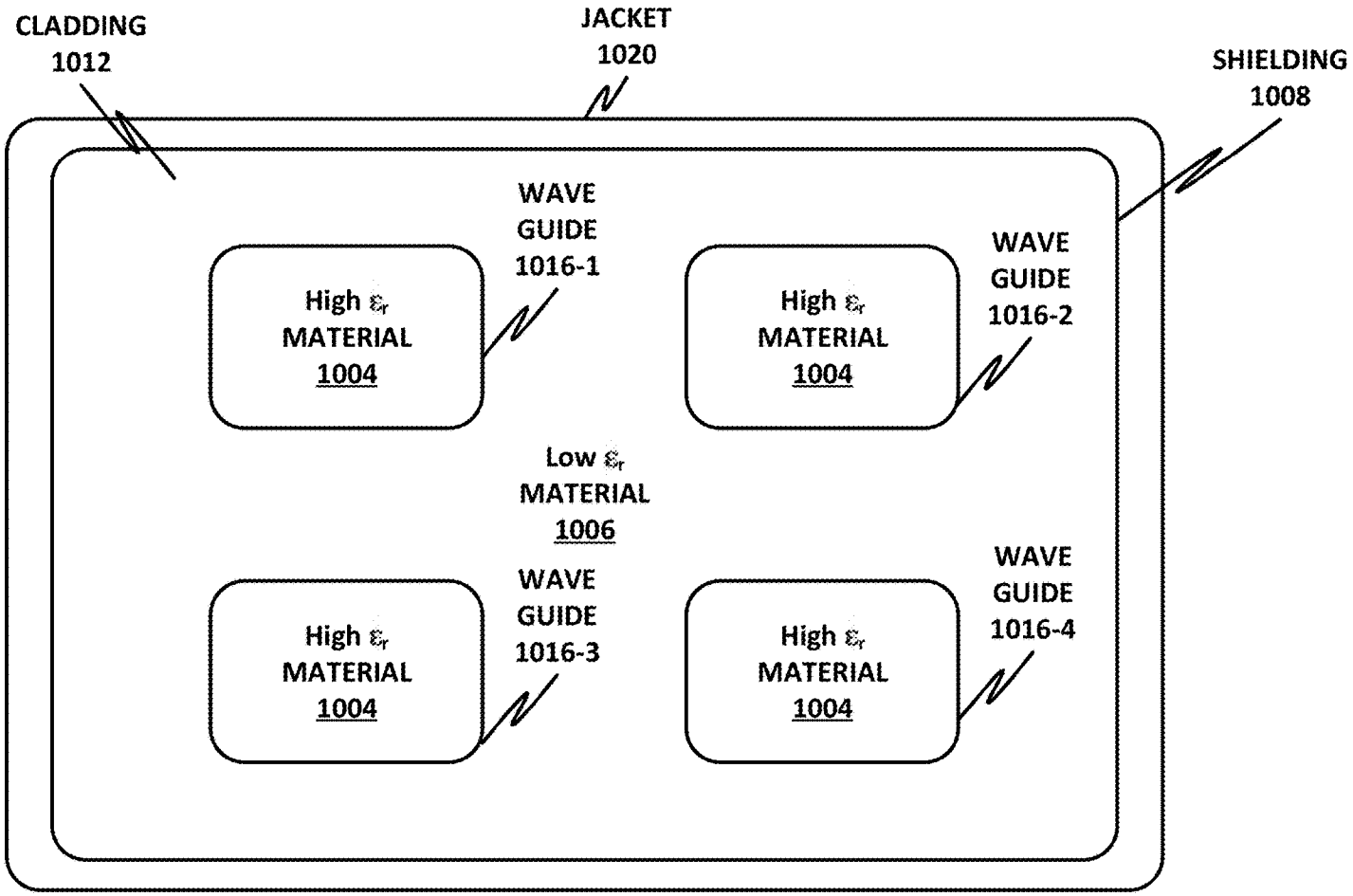
FIG. 10*a* is a cutaway front view of an example waveguide conductor.

FIG. 10*a* is a cutaway front view of an example waveguide conductor, wherein a plurality of waveguides (namely, waveguides 1016-1, 1016-2, 1016-3, and 1016-4) all co-reside within a single cladding 1012. Waveguides 1016-1, 1016-2, 1016-3, and 1016-4 are all constructed of high $\varepsilon_r$ material 1004, which may be the same high $\varepsilon_r$ material, or maybe two, three, or four different high $\varepsilon_r$ materials. As before, cladding 1012 may include a single low $\varepsilon_r$ material 1006 surrounded by shielding 1008 with a jacket 1020. In this case, high-frequency signals can be launched independently onto each respective waveguide 1016-1, 1016-2, 1016-3, and 1016-4, and a low-frequency signal can also be launched onto cladding 1004. As in the previous examples, a launcher may be codesigned with the cable to provide launchers onto each respective waveguide 1016-1, 1016-2, 1016-3, and 1016-4 and, for example, into the center of cladding 1012. In one embodiment, waveguides 1016-1, 1016-2, 1016-3, and 1016-4 may be high-permittivity core waveguides oriented toward the edge of cladding 1012 to maximize the distance between waveguides 1016-1, 1016-2, 1016-3, and 1016-4, and to minimize interference between them and between the signals on cladding 1012.

Figure 10B:
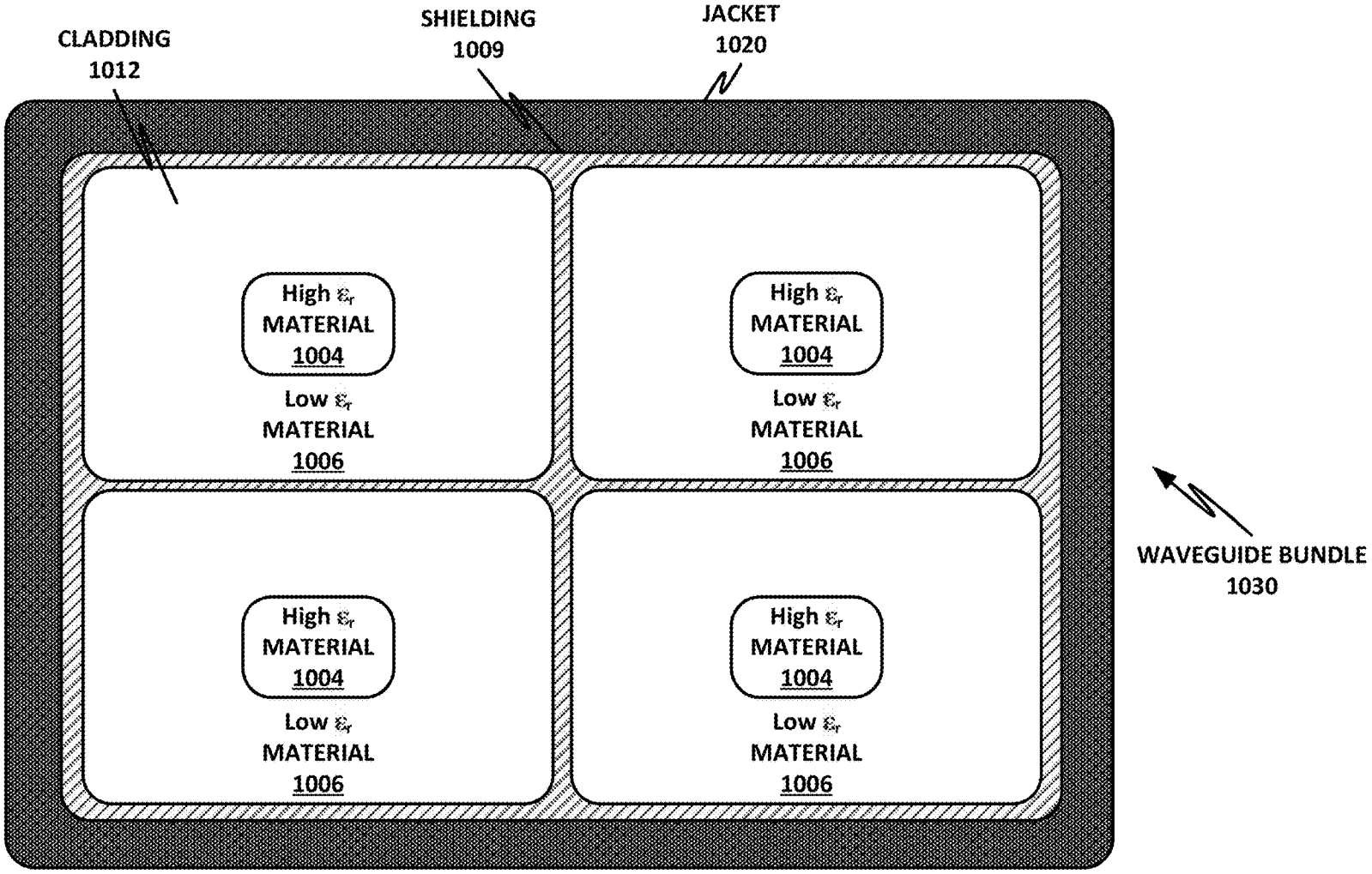
FIG. 10*b* is a cutaway front view of an example waveguide conductor bundle assembly.

FIG. 10*b* is a cutaway front view of an example waveguide conductor bundle assembly. Waveguide bundle 1030 is in many respects substantially similar to the waveguide of FIG. 10*a*, with the exception that shielding 1009 does not monolithically cover the whole waveguide as in shielding 1008 of FIG. 10*a*. Rather, shielding 1009 wraps each waveguide individually. In effect, this makes a plurality of individual wave guides (similar to wave guide 300 of FIG. 3) that are bundled together to increase the data density of the cable assembly. The individual shielding 1009 helps to avoid crosstalk between the individual waveguides.

Figure 11A:
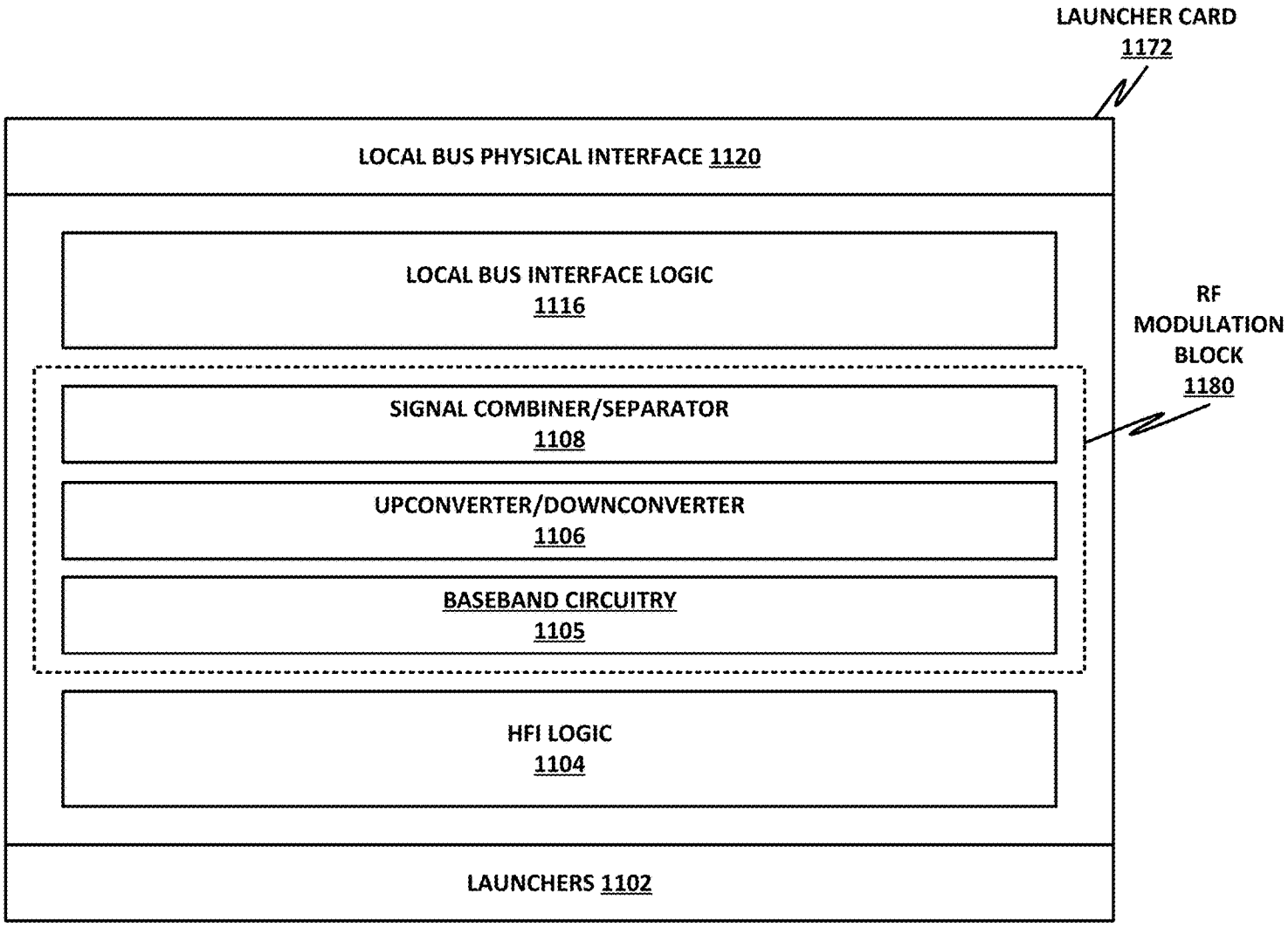
FIG. 11*a* is a block diagram of an example launcher card.
Figure 11B:
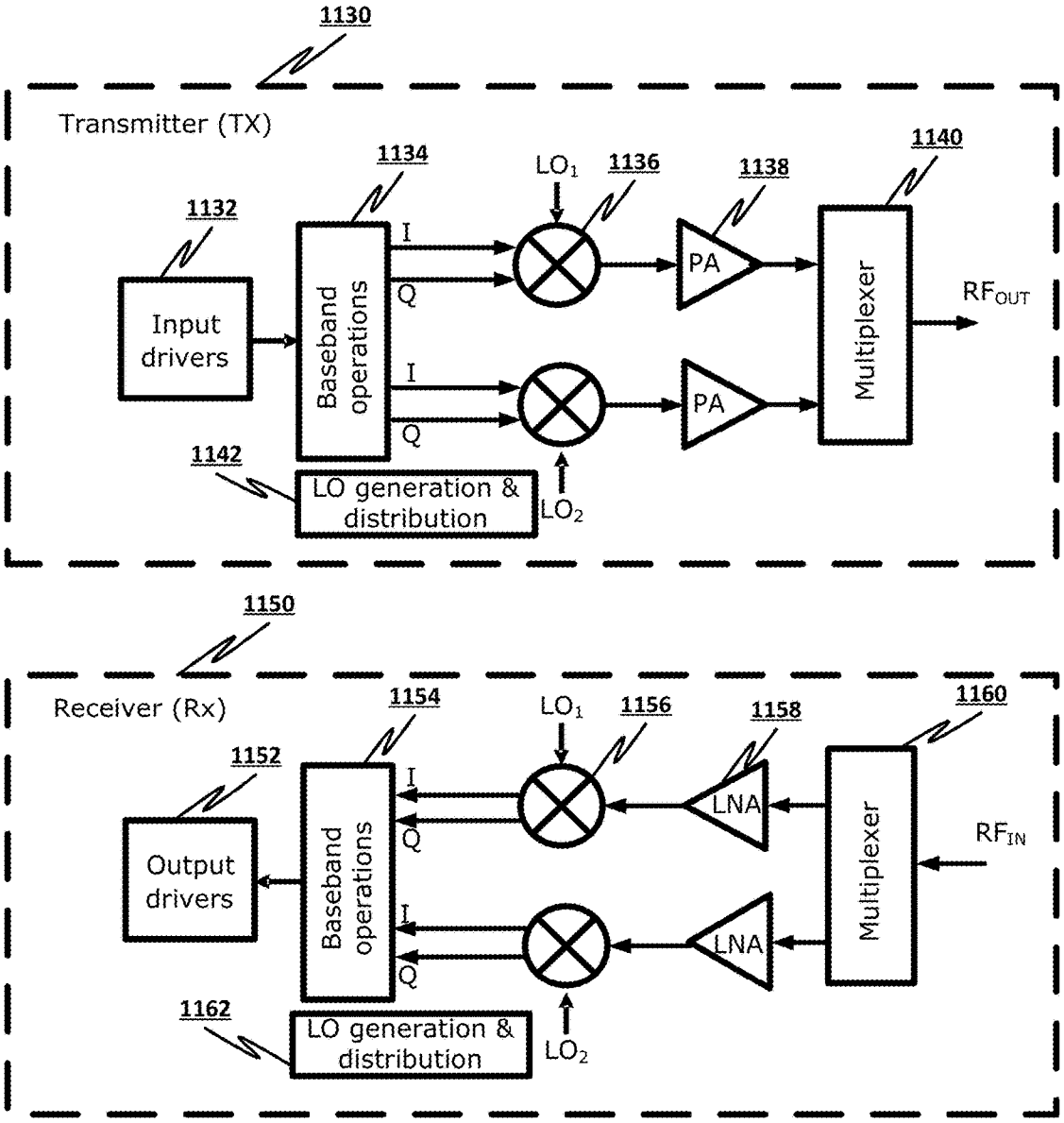
FIG. 11*b* is a block diagram of selected additional elements of a radio frequency (RF) modulation block.

FIG. 11*a* is a block diagram of an example launcher card 1172. This launcher card 1172 is provided by way of nonlimiting example only. It should be noted in particular that launcher card 1172 may be a separate pluggable card, such as a peripheral component interconnect express (PCIe) card, or it may be tightly integrated and on-die with its host core. Launcher card 1172 includes RF modulation block 1180. RF modulation block 1180 includes a baseband circuitry 1105. Upconverter/Downconverter 1106 may include modulation capabilities. Additional details of baseband circuitry 1105 are illustrated in FIG. 11*b*.

Signal combiner/separator 1108 may be configured to separate signals into low-frequency components and one or more high-frequency components. This is to enable the data to be propagated over the different media, as illustrated in this specification. This can include separating out data of different frequency spectra, so that data that can be conveyed at lower frequencies can be transmitted via a low $\varepsilon_r$ waveguide, while data that need to be transmitted at higher frequencies can be transmitted via a high $\varepsilon_r$ waveguide. In other embodiments, more complicated logic may be included, such as logic to separate monolithic data out into component parts for transmission along the different media, which can then be reconstructed at the other end by a signal combiner.

While launcher card 1172 is disclosed herein as the medium for hosting remote hardware acceleration (RHA) functions, these functions could just as well be hosted in another part of the machine. For example, a dedicated RHA chip could be provided, which itself could be very much like a hardware accelerator. Functions could be performed on a hardware block integrated into the core, or these functions could be performed in software on the core. Thus, the disclosure of remote hardware acceleration functions on launcher card 1172 in this FIGURE should be understood as a nonlimiting and illustrative example only, and the present disclosure should be understood to encompass any suitable hardware or software configuration for realizing remote hardware acceleration.

In this example, launcher card 1172 includes two physical interfaces, namely a local bus physical interface 1120 and launchers 1102.

Local bus interface 1120 may provide a physical interface to a local bus on the host, such as a PCIe interface or other local interconnect. Local bus physical interface 1120 is provided as a nonlimiting example, and it should be understood that other interconnect methods are possible. For example, in cases where launcher card 1172 is tightly coupled with its accompanying core, local bus physical interface 1120 could be provided by direct, on-die trace lines, or direct copper connections on an integrated circuit board. In other examples, a bus interface other than PCIe could be used.

Figure 13:
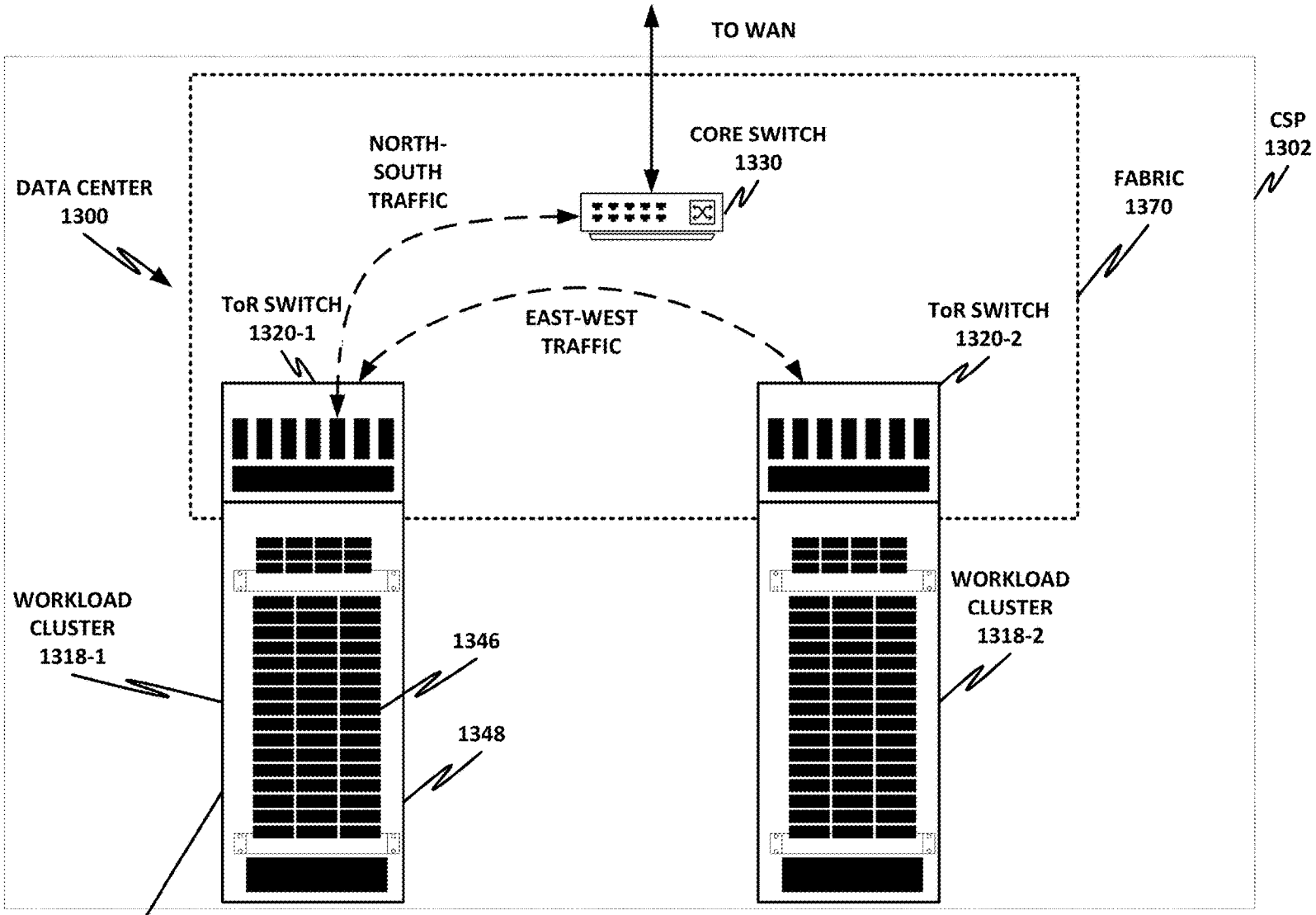
FIG. 13 is a block diagram illustrating selected components of a data center with network connectivity.

Launchers 1102 provide the physical interconnect to a fabric, such as fabric 1370 of FIG. 13 or any of the fabrics disclosed herein. Launchers 1102 may be configured to connect launcher card 1172 to any suitable fabric.

In one particular example, the Intel® Omni-Path™ fabric may be used. The Omni-Path™ fabric is advantageous because it allows mapping of addresses and memory ranges between different coherent domains. A system may include one or more coherent domains wherein all coherent domains are connected to each other via a fabric. Caching agents are the coherency agents within a node that process memory requests from cores within the same node, thus providing the coherency of the domain. Home agents are node clusters that are responsible for processing memory requests from the caching agents, and act as a home for part of the memory address space. Multiple homes may be provided on a single die with a distributed address space mapping. Depending on the address space that a request targets, the request may be routed to the same node's local memory, or it may go to an Intel® UltraPath Interconnect (UPI) agent, for example, which may route the request to other processors within the same coherent domain. Alternately, a request may go through the launcher card 1172 to processors that are outside the coherent domain. All processors connected via the UPI belong to the same coherent domain. Thus, in one embodiment, launcher card 1172 may communicate with an Omni-Path™ fabric via UPI tunneling.

This communication may be facilitated via host fabric interface (HFI) logic 1104, which provides logic elements and instructions necessary to provide communication within a coherent domain, and across the fabric with different coherent domains. HFI logic 1104 may also include logic to translate local requests into remote fabric requests.

On the other hand, local bus interface logic 1116 may provide logic for interfacing with the local bus, such as a PCIe bus, or a dedicated copper connection. Alternately, traffic through launcher card 1172 may follow a path through local bus physical interface 1120, local bus interface logic 1116, HFI logic 1104, and launchers 1102 out to the fabric.

Figure 12:
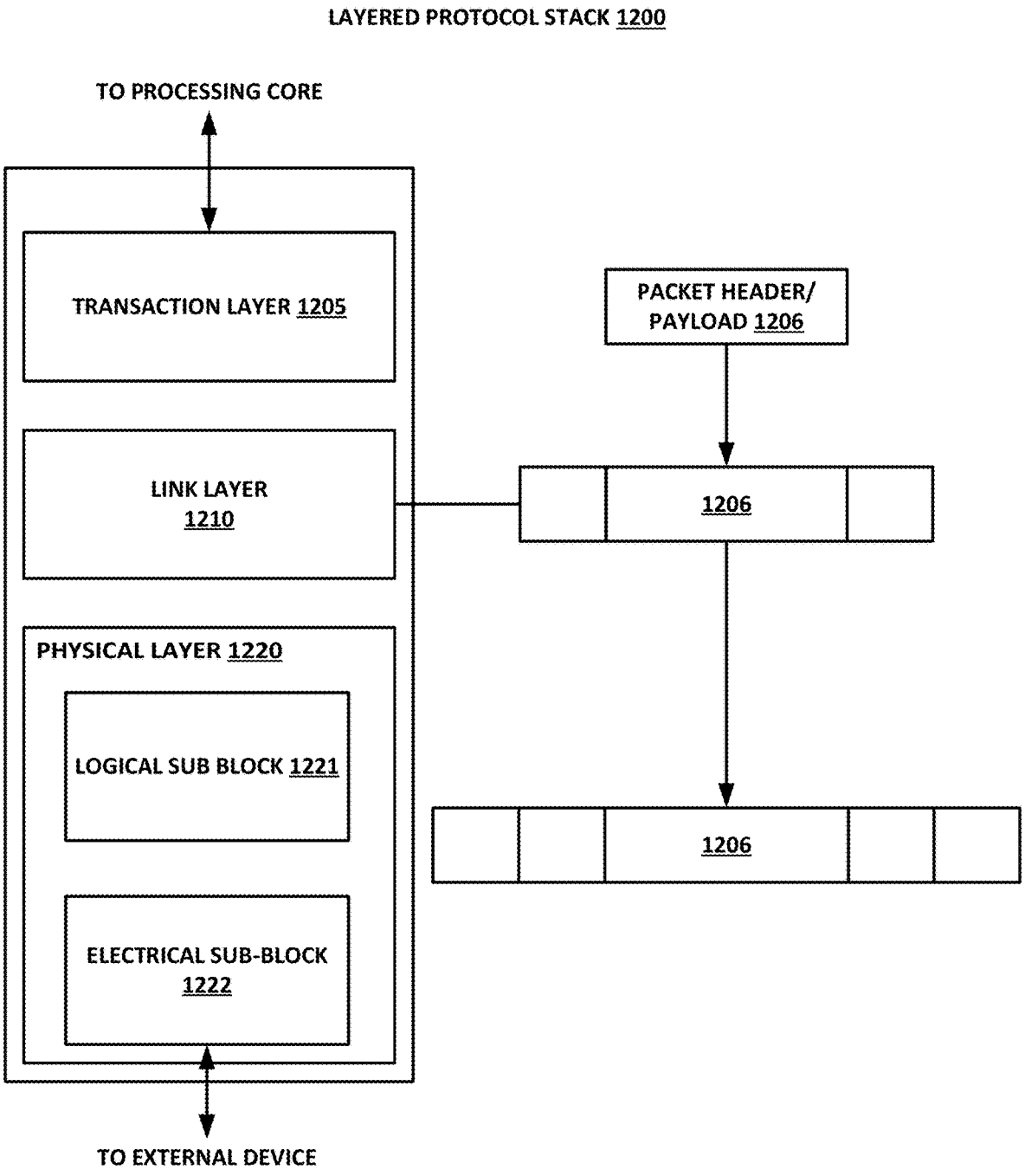
FIG. 12 is a block diagram of an example layered protocol stack.

FIG. 11*b* is a block diagram illustrating selected additional elements of RF modulation block 1180, including elements of baseband circuitry 1105 as depicted in FIG. 11*a*. Modulation block 1180 may include a transmitter (Tx) block 1130 and a receiver (Rx) block 1150. These blocks may further include input and output signal drivers, conditioning circuits 1132 and 1152, baseband operations circuitry 1134 and 1154, local oscillator (LO) generation and distribution circuitry 1142 and 1162, upconversion 1136, downconversion 1156, modulation circuitry, amplifying circuitry such as a power amplifier (PA) 1138, a low noise amplifier (LNA) 1158, and multiplexer 1140 and 1160. Shown in this figure are two local oscillators, labeled LO1 and LO2 respectively, for each one of transmitter 1130 and receiver 1150. These oscillators provide (in-phase and quadrature) (I/O) modulation, with I and Q waveforms labeled. RF input signals are labeled RFin and RF output signals are labeled RFout. In FIG. 12, signals to the processing core are labeled "TO PROCESSING CORE" and signals to external devices are labeled "TO EXTERNAL DEVICE."

While FIG. 11*b* illustrates an example RF modulation block wherein the Tx and Rx implementations are provided with dual front-end chains, the teachings of this specification are not so limited. By way of nonlimiting example, only one upconversion and PA chain may be provided in Tx block 1130, or similarly one LNA and downconversion chain may be provided in Rx block 1150. In other embodiments, three or more chains may be provided for operation at three or more different carrier frequencies for implementation in a multiplexed system with frequency division. Other embodiments may be provided consistent with the teachings of the present specification.

Baseband circuitry blocks 1134 and 1154 may include, by way of illustrative example, equalizing circuitry such as continuous time linear equalizers (CTLE), decision feedback equalizers (DFE), and finite impulse response (FIR) filter-based equalizers. Additionally blocks 1134 and 1154 may include, for example, clock data recovery (CDR) circuits, phase-locked loop (PLL) circuitry, analog to digital converters (ADCs) and digital to analog converters (DACs), a custom digital processing unit, and a serializer/deserializer (SERDES) circuit.

Baseband processing unit 1134 and 1154 may implement signal filtering algorithms, serial to parallel conversion, phase equalization algorithms, dispersion compensation algorithms, Fourier transforms and inverse Fourier transforms. The LO generation and distribution circuitry 1142 and 1162 may include, for example, voltage or digitally controlled oscillators (VCOs or DCOs), passive hybrids, phase shifters, frequency multipliers and amplitude and phase correction circuitry.

FIG. 12 is a block diagram of an example layered protocol stack 1200. Layered protocol stack 1200 includes any form of a layered communication stack, such as an Intel® Quick-Path Interconnect (QPI) stack, a PCIe stack, a next generation HPC interconnect stack, or other layered stack. Embodiments of layered protocol stack 1200 disclosed herein may be adapted or configured to provide a multiband waveguide interconnect, according to the teachings of the present specification. In one embodiment, protocol stack 1200 is a PCIe protocol stack including transaction layer 1205, link layer 1210, and physical layer 1220. Representation as a communication protocol stack may also be referred to as a module or interface implementing/including a protocol stack.

PCIe uses packets to communicate information between components. Packets are formed in the transaction layer 1205 and data link layer 1210 to carry the information from the transmitting component to the receiving component. As the transmitted packets flow through the other layers, these transmitted packets are extended with additional information necessary to handle packets at those layers. At the receiving side the reverse process occurs and packets get transformed from their physical layer 1220 representation to the data link layer 1210 representation and finally (for transaction layer packets) to the form that can be processed by the transaction layer 1205 of the receiving device.

Transaction Layer

In one embodiment, transaction layer 1205 is to provide an interface between a device's processing core and the interconnect architecture, such as data link layer 1210 and physical layer 1220. Physical layer 1220 includes a logical sub block 1221 and an electrical sub block 1222. In this regard, a primary responsibility of the transaction layer 1205 is the assembly and disassembly of packets, i.e., transaction layer packets (TLPs). The translation layer 1205 typically manages credit-based flow control for TLPs. PCIe implements split transactions, i.e., transactions with request and response separated by time, allowing a link to carry other traffic while the target device gathers data for the response.

In addition, PCIe utilizes credit-based flow control. In this scheme, a device advertises an initial amount of credit for each of the receive buffers in transaction layer 1205. An external device at the opposite end of the link counts the number of credits consumed by each TLP. A transaction may be transmitted if the transaction does not exceed a credit limit. Upon receiving a response an amount of credit is restored. An advantage of a credit scheme is that the latency of credit return does not affect performance, provided that the credit limit is not encountered.

In one embodiment, four transaction address spaces include a configuration address space, a memory address space, an input/output address space, and a message address space. Memory space transactions include one or more read requests and write requests to transfer data to/from a memory-mapped location. In one embodiment, memory space transactions are capable of using two different address formats, e.g., a short address format, such as a 32-bit address, or a long address format, such as a 64-bit address. Configuration space transactions are used to access configuration space of PCIe devices. Transactions to the configuration space include read requests and write requests. Message space transactions (more simply referred to as messages) are defined to support in-band communication between PCIe agents.

Therefore, in one embodiment, transaction layer 1205 assembles packet header/payload 1206. Format for current packet headers/payloads may be found in the PCIe specification at the PCIe specification website.

FIG. 13 is a block diagram illustrating selected components of a data center 1300 with network connectivity. Embodiments of data center 1300 disclosed herein may be adapted or configured to provide a multiband waveguide interconnect, according to the teachings of the present specification. Data center 1300 is disclosed in this illustration as a data center operated by a cloud service provider 1302, but this is an illustrative example only. The principles illustrated herein may also be applicable to a high-performance computing cluster, a smaller "edge" data center, a microcloud, or other interconnected compute structure.

Cloud service provider 1302 may be, by way of nonlimiting example, a traditional enterprise data center, an enterprise "private cloud," or a "public cloud," providing services such as infrastructure as a service (IaaS), platform as a service (PaaS), or software as a service (SaaS). In some cases, cloud service provider 1302 may provide, instead of or in addition to cloud services, high-performance computing platforms or services. Indeed, while not expressly identical, high-performance computing clusters ("supercomputers") may be structurally similar to cloud data centers, and unless expressly specified, the teachings of this specification may be applied to either. In general usage, the "cloud" is considered to be separate from an enterprise data center. Whereas an enterprise data center may be owned and operated on-site by an enterprise, a cloud service provider provides third-party compute services to a plurality of "tenants." Each tenant may be a separate user or enterprise, and may have its own allocated resources, service-level agreements (SLAB), and similar.

Cloud service provider 1302 may provision some number of workload clusters, which may be clusters of individual servers, blade servers, rackmount servers, or any other suitable server topology. In this illustrative example, two respective workload clusters, 1318-1 and 1318-2, are shown, each providing rackmount servers 1346 in a chassis 1348.

In this illustration, workload clusters 1318 are shown as modular workload clusters conforming to the rack unit ("U") standard, in which a standard rack, 19 inches wide, may accommodate up to 42 units (42 U), each 1.75 inches high and approximately 36 inches deep. In this case, compute resources such as processors, memory, storage, accelerators, and switches may fit into some multiple of rack units from 1 U to 42 U.

In the case of a traditional rack-based data center, each server 1346 may host a standalone operating system and provide a server function, or servers may be virtualized, in which case they may be under the control of a virtual machine manager (VMM), hypervisor, and/or orchestrator. Each server may then host one or more virtual machines, virtual servers, or virtual appliances. These server racks may be collocated in a single data center, or may be located in different geographic data centers. Depending on contractual agreements, some servers 1346 may be specifically dedicated to certain enterprise clients or tenants, while others may be shared.

The various devices in a data center may be connected to each other via a switching fabric 1370, which may include one or more high speed routing and/or switching devices. Switching fabric 1370 may provide both "north-south"

traffic (e.g., traffic to and from the wide area network (WAN), such as the Internet), and "east-west" traffic (e.g., traffic across the data center). Historically, north-south traffic accounted for the bulk of network traffic, but as web services become more complex and distributed, the volume of east-west traffic has risen. In many data centers, east-west traffic now accounts for the majority of traffic.

Furthermore, as the capability of each server 1346 increases, traffic volume may further increase. For example, each server 1346 may provide multiple processor slots, with each slot accommodating a processor having four to eight cores, along with sufficient memory for the cores. Thus, each server may host a number of virtual machines (VMs), each generating its own traffic.

To accommodate the large volume of traffic in a data center, a highly capable switching fabric 1370 may be provided. As used throughout this specification, a "fabric" should be broadly understood to include any combination of physical interconnects, protocols, media, and support resources that provide communication between one or more first discrete devices and one or more second discrete devices. Fabrics may be one-to-one, one-to-many, many-to-one, or many-to-many.

In some embodiments, fabric 1370 may provide communication services on various "layers," as outlined in the Open Systems Interconnection (OSI) seven-layer network model. In contemporary practice, the OSI model is not followed strictly. In general terms, layers 1 and 2 are often called the "Ethernet" layer (though in some data centers or supercomputers, Ethernet may be supplanted or supplemented by newer technologies). Layers 3 and 4 are often referred to as the transmission control protocol/internet protocol (TCP/IP) layer (which may be further sub-divided into TCP and IP layers). Layers 5-7 may be referred to as the "application layer." These layer definitions are disclosed as a useful framework, but are intended to be nonlimiting.

Switching fabric 1370 is illustrated in this example as a "flat" network, wherein each server 1346 may have a direct connection to a top-of-rack (ToR) switch 1320-1 or 1320-2 (e.g., a "star" configuration). Note that ToR is a common and historical name, and ToR switches 1320-1 or 1320-2 may, in fact, be located anywhere on the rack. Some data centers place ToR switches in the middle of the rack to reduce the average overall cable length.

Each ToR switch 1320 may couple to a core switch 1330. This two-tier flat network architecture is shown only as an illustrative example. In other examples, other architectures may be used, such as three-tier star or leaf-spine (also called "fat tree" topologies) based on the "Clos" architecture named after telecommunications pioneer Charles Clos, hub-and-spoke topologies, mesh topologies, ring topologies, or 3-D mesh topologies, by way of nonlimiting example.

The fabric itself may be provided by any suitable interconnect. For example, each server 1346 may include an Intel® Host Fabric Interface (HFI), a network interface card (NIC), intelligent NIC (iNIC), smart NIC, a host channel adapter (HCA), or other host interface. For simplicity and unity, these may be referred to throughout this specification as a "fabric adapter" (FA), which should be broadly construed as an interface to communicatively couple the host to the data center fabric. The FA may couple to one or more host processors via an interconnect or bus, such as PCI, PCIe, or similar, referred to herein as a "local fabric." Multiple processor may communicate with one another via a special interconnects such as a core-to-core Intel® Ultra-Path Interconnect (UPI), Infinity Fabric, etc. Generically, these interconnects may be referred to as an "inter-processor fabric." The treatment of these various fabrics may vary from vendor to vendor and from architecture to architecture. In some cases, one or both of the local fabric and the inter-processor fabric may be treated as part of the larger data center fabric. Some FAs have the capability to dynamically handle a physical connection with a plurality of protocols (e.g., either Ethernet or PCIe, depending on the context), in which case PCIe connections to other parts of a rack may usefully be treated as part of the fabric. In other embodiments, PCIe is used exclusively within a local node, sled, or sled chassis, in which case it may not be logical to treat the local fabric as part of the data center fabric. In yet other embodiments, it is more logical to treat the inter-processor fabric as part of the secure domain of the processor complex, and thus treat it separately from the local fabric and/or data center fabric. In particular, the inter-processor fabric may be cache and/or memory coherent, meaning that coherent devices can map to the same memory address space, with each treating that address space as its own local address space. Many data center fabrics and local fabrics lack coherency, and so it may be beneficial to treat inter-processor fabric, the local fabric, and the data center fabric as one cohesive fabric, or two or three separate fabrics. Furthermore, the illustration of three levels of fabric in this example should not be construed to exclude more or fewer levels of fabrics, or the mixture of other kinds of fabrics. For example, many data centers use copper interconnects for short communication distances, and fiber optic interconnects for longer distances.

Thus, fabric 1370 may be provided by a single interconnect or a hybrid interconnect, such as where PCIe provides on-chip (for a system-on-a-chip) or on-board communication, 1 gigabit (Gb) or 10 Gb copper Ethernet provides relatively short connections to a ToR switch, and optical cabling provides relatively longer connections to core switch 1330. Interconnect technologies that may be found in the data center include, by way of nonlimiting example, Intel® silicon photonics, an Intel® HFI, a NIC, intelligent NIC (iNIC), smart NIC, an HCA or other host interface, PCI, PCIe, a core-to-core unified physical infrastructure (UPI), Infinity Fabric, Intel® Omni-Path™ Architecture (OPA), TrueScale™, FibreChannel, Ethernet, FibreChannel over Ethernet (FCoE), InfiniBand, a legacy interconnect such as a local area network (LAN), a token ring network, a synchronous optical network (SONET), an asynchronous transfer mode (ATM) network, a wireless network such as Wi-Fi or Bluetooth, a "plain old telephone system" (POTS) interconnect or similar, a multi-drop bus, a mesh interconnect, a point-to-point interconnect, a serial interconnect, a parallel bus, a coherent (e.g., cache coherent) bus, a layered protocol architecture, a differential bus, or a Gunning transceiver logic (GTL) bus, to name just a few. The fabric may be cache and memory coherent, cache and memory non-coherent, or a hybrid of coherent and non-coherent interconnects. Some interconnects are more popular for certain purposes or functions than others, and selecting an appropriate fabric for the instant application is an exercise of ordinary skill. For example, OPA and Infiniband are commonly used in HPC applications, while Ethernet and FibreChannel are more popular in cloud data centers. But these examples are expressly nonlimiting, and as data centers evolve fabric technologies similarly evolve.

Note that while high-end fabrics such as OPA are provided herein by way of illustration, more generally, fabric 1370 may be any suitable interconnect or bus for the particular application. This could, in some cases, include legacy interconnects like LANs, token ring networks, synchronous optical networks (SONET), ATM networks, wireless networks such as Wi-Fi and Bluetooth, POTS interconnects, or similar. It is also expressly anticipated that in the future, new network technologies may arise to supplement or replace some of those listed here, and any such future network topologies and technologies can be or form a part of fabric 1370.

Figure 14:
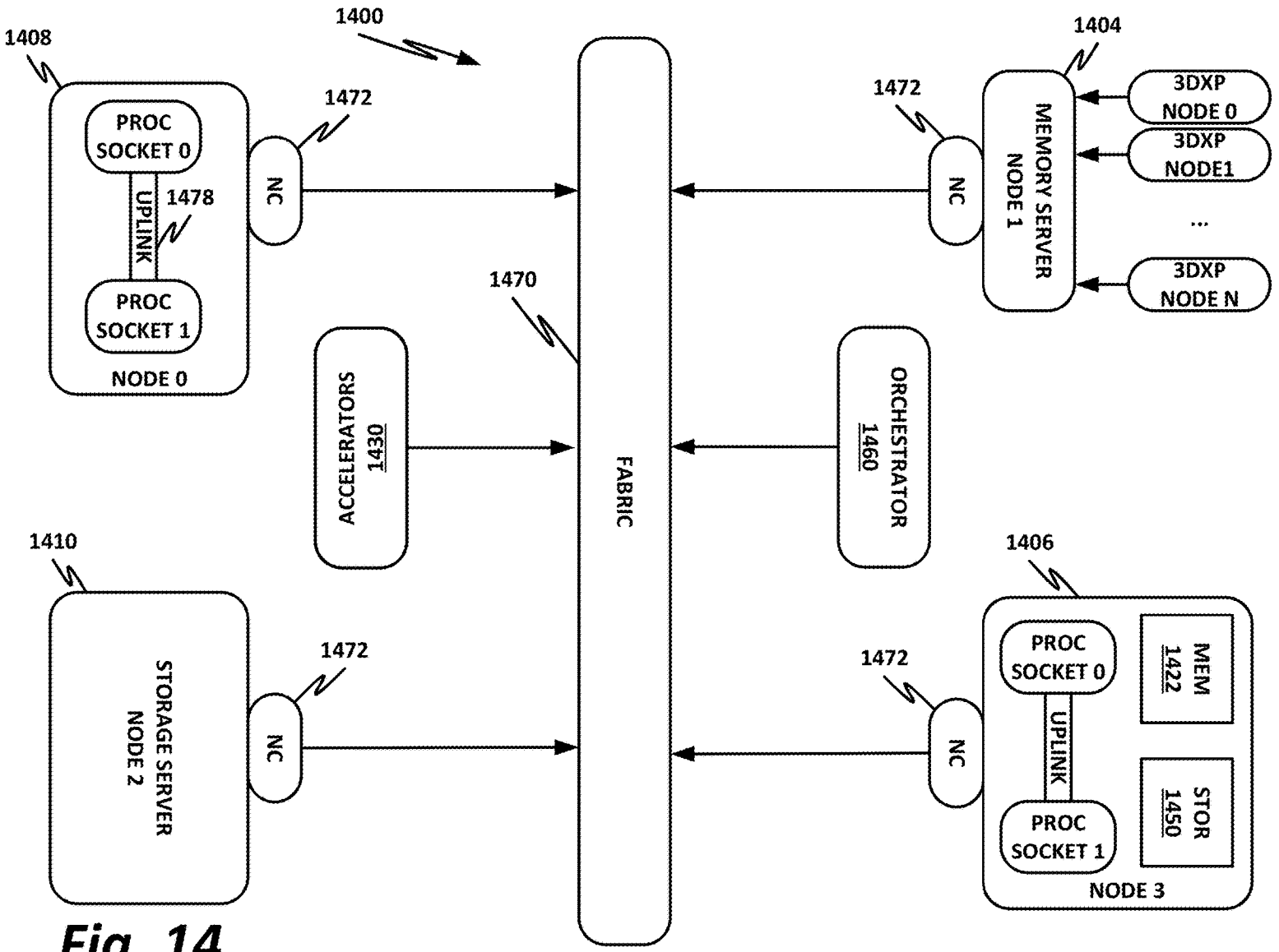
FIG. 14 is a block diagram illustrating selected components of an end-user computing device.

FIG. 14 is a block diagram illustrating selected components of an end-user computing device 1400. Embodiments of computing device 1400 disclosed herein may be adapted or configured to provide a multiband waveguide interconnect, according to the teachings of the present specification. As above, computing device 1400 may provide, as appropriate, cloud service, HPC, telecommunication services, enterprise data center services, or any other compute services that benefit from a computing device 1400. Computing device 1400 includes an orchestrator 1460.

In this example, a fabric 1470 is provided to interconnect various aspects of computing device 1400. Fabric 1470 may be the same as fabric 1370 of FIG. 13, or may be a different fabric. As above, fabric 1470 may be provided by any suitable interconnect technology. In this example, Intel® Omni-Path™ is used as an illustrative and nonlimiting example.

As illustrated, computing device 1400 includes a number of logic elements forming a plurality of nodes. It should be understood that each node may be provided by a physical server, a group of servers, or other hardware. Each server may be running one or more VMs as appropriate to its application.

Node 0 1408 is a processing node including a processor (PROC) socket 0 and processor (PROC) socket 1. The processors may be, for example, Intel® Xeon™ processors with a plurality of cores, such as 4 or 8 cores. Node 0 1408 may be configured to provide network or workload functions, such as by hosting a plurality of VMs or virtual appliances.

On-board communication between processor socket 0 and processor socket 1 may be provided by an on-board uplink 1478. This may provide a very high speed, short-length interconnect between the two processor sockets, so that VMs running on node 0 1408 can communicate with one another at very high speeds. To facilitate this communication, a virtual switch (vSwitch) may be provisioned on node 0 1408, which may be considered to be part of fabric 1470.

Node 0 1408 connects to fabric 1470 via a network controller (NC) 1472. NC 1472 provides physical interface (or PHY level) and logic to communicatively couple a device to a fabric. For example, NC 1472 may be a NIC to communicatively couple to an Ethernet fabric or an HFI to communicatively couple to a clustering fabric such as an Intel® Omni-Path™, by way of illustrative and nonlimiting example. In some examples, communication with fabric 1470 may be tunneled, such as by providing UPI tunneling over Omni-Path™.

Because computing device 1400 may provide many functions in a distributed fashion that in previous generations were provided on-board, a highly capable NC 1472 may be provided. NC 1472 may operate at speeds of multiple gigabits per second, and in some cases may be tightly coupled with node 0 1408. For example, in some embodiments, the logic for NC 1472 is integrated directly with the processors on a system-on-a-chip (SoC). This provides very high speed communication between NC 1472 and the processor sockets, without the need for intermediary bus devices, which may introduce additional latency into the fabric. However, this is not to imply that embodiments where NC 1472 is provided over a traditional bus are to be excluded. Rather, it is expressly anticipated that in some examples, NC 1472 may be provided on a bus, such as a PCIe bus, which is a serialized version of PCI that provides higher speeds than traditional PCI. Throughout computing device 1400, various nodes may provide different types of NCs 1472, such as on-board NCs and plug-in NCs. It should also be noted that certain blocks in an SoC may be provided as intellectual property (IP) blocks that can be "dropped" into an integrated circuit as a modular unit. Thus, NC 1472 may in some cases be derived from such an IP block.

Note that in "the network is the device" fashion, node 0 1408 may provide limited or no on-board memory or storage. Rather, node 0 1408 may rely primarily on distributed services, such as a memory server and a networked storage server. On-board, node 0 1408 may provide only sufficient memory and storage to bootstrap the device and get it communicating with fabric 1470. This kind of distributed architecture is possible because of the very high speeds of contemporary data centers, and may be advantageous because there is no need to over-provision resources for each node. Rather, a large pool of high speed or specialized memory may be dynamically provisioned between a number of nodes, so that each node has access to a large pool of resources, but those resources do not sit idle when that particular node does not need them.

In this example, a node 1 memory server 1404 and a node 2 storage server 1410 provide the operational memory and storage capabilities of node 0 1408. For example, memory server node 1 1404 may provide remote direct memory access (RDMA), whereby node 0 1408 may access memory resources on node 1 1404 via fabric 1470 in a direct memory access fashion, similar to how it would access its own on-board memory. The memory provided by memory server 1404 may be traditional memory, such as double data rate type 3 (DDR3) dynamic random access memory (DRAM), which is volatile, or may be a more exotic type of memory, such as a persistent fast memory (PFM) like Intel® 3D Crosspoint™ (3DXP), which operates at DRAM-like speeds, but is non-volatile. Connected to memory server 1404 is a plurality of 3DXP servers labeled NODE 0 . . . NODE N.

Similarly, rather than providing an on-board hard disk for node 0 1408, a storage server node 2 1410 may be provided. Storage server 1410 may provide a networked bunch of disks (NBOD), PFM, redundant array of independent disks (RAID), redundant array of independent nodes (RAIN), network-attached storage (NAS), optical storage, tape drives, or other non-volatile memory solutions.

Thus, in performing its designated function, node 0 1408 may access memory from memory server 1404 and store results on storage provided by storage server 1410. Each of these devices couples to fabric 1470 via an NC 1472, which provides fast communication that makes these technologies possible.

By way of further illustration, node 3 1406 is also depicted. Node 3 1406 also includes an NC 1472, along with two processor sockets internally connected by an uplink. However, unlike node 0 1408, node 3 1406 includes its own on-board memory (MEM) 1422 and storage (STOR) 1450. Thus, node 3 1406 may be configured to perform its functions primarily on-board, and may not be required to rely upon memory server 1404 and storage server 1410. However, in appropriate circumstances, node 3 1406 may supplement its own on-board memory 1422 and storage 1450 with distributed resources similar to node 0 1408.

Computing device 1400 may also include accelerators 1430. These may provide various accelerated functions, including hardware or co-processor acceleration for functions such as packet processing, encryption, decryption, compression, decompression, network security, or other accelerated functions in the data center. In some examples, accelerators 1430 may include deep learning accelerators that may be directly attached to one or more cores in nodes such as node 0 1408 or node 3 1406. Examples of such accelerators can include, by way of nonlimiting example, Intel® QuickData Technology (QDT), Intel® QuickAssist Technology (QAT), Intel® Direct Cache Access (DCA), Intel® Extended Message Signaled Interrupt (MSI-X), Intel® Receive Side Coalescing (RSC), and other acceleration technologies.

In other embodiments, an accelerator could also be provided as an application-specific integrated circuit (ASIC), field-programmable gate array (FPGA), co-processor, graphics processing unit (GPU), digital signal processor (DSP), or other processing entity, which may optionally be tuned or configured to provide the accelerator function.

The basic building block of the various components disclosed herein may be referred to as "logic elements." Logic elements may include hardware (including, for example, a software-programmable processor, an ASIC, or an FPGA), external hardware (digital, analog, or mixed-signal), software, reciprocating software, services, drivers, interfaces, components, modules, algorithms, sensors, components, firmware, microcode, programmable logic, or objects that can coordinate to achieve a logical operation. Furthermore, some logic elements are provided by a tangible, non-transitory computer-readable medium having stored thereon executable instructions for instructing a processor to perform a certain task. Such a non-transitory medium could include, for example, a hard disk, solid state memory or disk, read-only memory (ROM), program flash memory (PFM, e.g., Intel® 3D Crosspoint™), external storage, RAID, RAIN, NAS, optical storage, tape drive, backup system, cloud storage, or any combination of the foregoing by way of nonlimiting example. Such a medium could also include instructions programmed into an FPGA, or encoded in hardware on an ASIC or processor.

Figure 15:
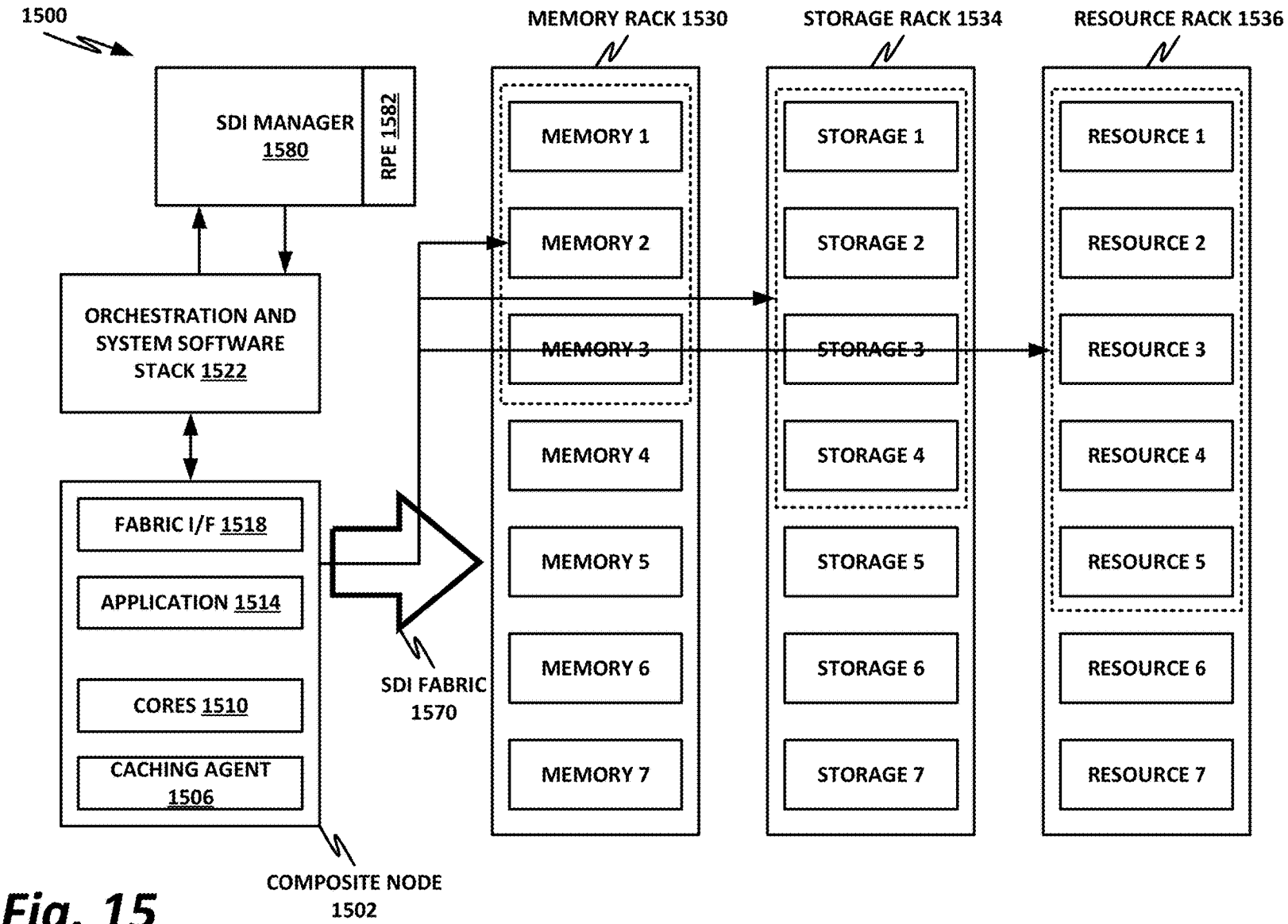
FIG. 15 is a block diagram of a software-defined infrastructure (SDI) data center.

FIG. 15 is a block diagram of a software-defined infrastructure (SDI) data center 1500. Embodiments of SDI data center 1500 disclosed herein may be adapted or configured to provide a multiband waveguide interconnect, according to the teachings of the present specification. Certain applications hosted within SDI data center 1500 may employ a set of resources to achieve their designated purposes, such as processing database queries, serving web pages, or providing computer intelligence.

Certain applications tend to be sensitive to a particular subset of resources. For example, a systems applications and products high-performance analytic appliance (SAP HANA) is an in-memory, column-oriented relational database system. A SAP HANA database may use processors, memory, disk, and fabric, while being most sensitive to memory and processors. In one embodiment, composite node 1502 includes one or more cores 1510 that perform the processing function. Node 1502 may also include caching agents 1506 that provide access to high speed cache. One or more applications 1514 run on node 1502, and communicate with the SDI fabric via fabric interface (FABRIC I/F) 1518. Dynamically provisioning resources to node 1502 may include selecting a set of resources and ensuring that the quantities and qualities provided meet required performance indicators, such as service-level agreements (SLAB) and quality of service (QoS). Resource selection and allocation for application 1514 may be performed by a resource manager, which may be implemented within orchestration and system software stack 1522. By way of nonlimiting example, throughout this specification the resource manager may be treated as though it can be implemented separately or by an orchestrator. Note that many different configurations are possible.

Composite Node 1502 communicates via an SDI fabric 1570. Memory rack 1530 includes in this illustration seven nodes (labeled MEMORY 1 . . . MEMORY 7). In an SDI data center, applications may be executed by a composite node such as node 1502 that is dynamically allocated by SDI manager 1580. Such nodes are referred to as composite nodes because they are not nodes where all of the resources are necessarily collocated. Rather, they may include resources that are distributed in different parts of the data center, dynamically allocated, and virtualized to the specific application 1514.

In this example, memory resources from three memory sleds from memory rack 1530 are allocated to node 1502, storage resources from four storage sleds from storage rack 1534 are allocated, and additional resources from five resource sleds from resource rack 1536 are allocated to application 1514 running on composite node 1502. Storage rack 1534 and resource rack 1536 respectively include in this illustration seven nodes (labeled STORAGE 1 . . . STORAGE 7 for storage rack 1534, and RESOURCE 1 . . . RESOURCE 7 for resource rack 1536). All of these resources may be associated to a particular compute sled and aggregated to create the composite node. Once the composite node is created, the operating system may be booted in node 1502, and the application may start running using the aggregated resources as if they were physically collocated resources. As described above, fabric interface (FABRIC I/F) 1518 may provide certain interfaces that enable this operation to occur seamlessly with respect to node 1502.

As a general proposition, the more memory and compute resources that are added to a database processor, the better throughput it can achieve. However, this is not necessarily true for the disk or fabric. Adding more disk and fabric bandwidth may not necessarily increase the performance of the SAP HANA database beyond a certain threshold.

SDI data center 1500 may address the scaling of resources by mapping an appropriate amount of offboard resources to the application based on application requirements provided by a user or network administrator or directly by the application itself. This may include allocating resources from various resource racks, such as memory rack 1530, storage rack 1534, and resource rack 1536.

In an example, SDI controller 1580 also includes a resource protection engine (RPE) 1582, which is configured to assign permission for various target resources to disaggregated compute resources (DRCs) that are permitted to access them. In this example, the resources are expected to be enforced by an FA servicing the target resource.

In certain embodiments, elements of SDI data center 1500 may be adapted or configured to operate with the disaggregated telemetry model of the present specification.

The foregoing outlines features of one or more embodiments of the subject matter disclosed herein. These embodiments are provided to enable a "person having ordinary skill in the art" (i.e., PHOSITA) to better understand various aspects of the present disclosure. Certain well-understood terms, as well as underlying technologies and/or standards may be referenced without being described in detail. It is anticipated that the PHOSITA will possess or have access to background knowledge or information in those technologies and standards sufficient to practice the teachings of the present specification.

The PHOSITA will appreciate that they may readily use the present disclosure as a basis for designing or modifying other processes, structures, or variations for carrying out the same purposes and/or achieving the same advantages of the embodiments introduced herein. The PHOSITA will also recognize that such equivalent constructions do not depart from the spirit and scope of the present disclosure, and that they may make various changes, substitutions, and alterations herein without departing from the spirit and scope of the present disclosure.

In the foregoing description, certain aspects of some or all embodiments are described in greater detail than is strictly necessary for practicing the appended claims. These details are provided by way of nonlimiting example only, for the purpose of providing context and illustration of the disclosed embodiments. Such details should not be understood to be required, and should not be "read into" the claims as limitations. The phrase may refer to "an embodiment" or "embodiments." These phrases, and any other references to embodiments, should be understood broadly to refer to any combination of one or more embodiments. Furthermore, the several features disclosed in a particular "embodiment" could just as well be spread across multiple embodiments. For example, if features 1 and 2 are disclosed in "an embodiment," embodiment A may have feature 1 but lack feature 2, while embodiment B may have feature 2 but lack feature 1.

This specification may provide illustrations in a block diagram format, wherein certain features are disclosed in separate blocks. These should be understood broadly to disclose how various features interoperate, but are not intended to imply that those features must necessarily be embodied in separate hardware or software. Furthermore, where a single block discloses more than one feature in the same block, those features need not necessarily be embodied in the same hardware and/or software. For example, a computer "memory" could in some circumstances be distributed or mapped between multiple levels of cache or local memory, main memory, battery-backed volatile memory, and various forms of persistent memory such as a hard disk, storage server, optical disk, tape drive, or similar. In certain embodiments, some of the components may be omitted or consolidated. In a general sense, the arrangements depicted in the FIGURES may be more logical in their representations, whereas a physical architecture may include various permutations, combinations, and/or hybrids of these elements. Countless possible design configurations can be used to achieve the operational objectives outlined herein. Accordingly, the associated infrastructure has a myriad of substitute arrangements, design choices, device possibilities, hardware configurations, software implementations, and equipment options.

References may be made herein to a computer-readable medium, which may be a tangible and non-transitory computer-readable medium. As used in this specification and throughout the claims, a "computer-readable medium" should be understood to include one or more computer-readable mediums of the same or different types. A computer-readable medium may include, by way of nonlimiting example, an optical drive (e.g., CD/DVD/Blu-Ray), a hard drive, a solid state drive, a flash memory, or other non-volatile medium. A computer-readable medium could also include a medium such as a ROM, an FPGA, or an ASIC configured to carry out the desired instructions, stored instructions for programming an FPGA or ASIC to carry out the desired instructions, an IP block that can be integrated in hardware into other circuits, or instructions encoded directly into hardware or microcode on a processor such as a microprocessor, DSP, microcontroller, or in any other suitable component, device, element, or object where appropriate and based on particular needs. A non-transitory storage medium herein is expressly intended to include any non-transitory special-purpose or programmable hardware configured to provide the disclosed operations, or to cause a processor to perform the disclosed operations.

Various elements may be "communicatively," "electrically," "mechanically," or otherwise "coupled" to one another throughout this specification and the claims. Such coupling may be a direct, point-to-point coupling, or may include intermediary devices. For example, two devices may be communicatively coupled to one another via a controller that facilitates the communication. Devices may be electrically coupled to one another via intermediary devices such as signal boosters, voltage dividers, or buffers. Mechanically coupled devices may be indirectly mechanically coupled.

Any "module" or "engine" disclosed herein may refer to or include software, a software stack, a combination of hardware, firmware, and/or software, a circuit configured to carry out the function of the engine or module, or any computer-readable medium as disclosed above. Such modules or engines may, in appropriate circumstances, be provided on or in conjunction with a hardware platform, which may include hardware compute resources such as a processor, memory, storage, interconnects, networks and network interfaces, accelerators, or other suitable hardware. Such a hardware platform may be provided as a single monolithic device (e.g., in a PC form factor), or with some or part of the function being distributed (e.g., a "composite node" in a high-end data center, where compute, memory, storage, and other resources may be dynamically allocated and need not be local to one another).

There may be disclosed herein flow charts, signal flow diagram, or other illustrations showing operations being performed in a particular order. Unless otherwise expressly noted, or unless required in a particular context, the order should be understood to be a nonlimiting example only. Furthermore, in cases where one operation is shown to follow another, other intervening operations may also occur, which may be related or unrelated. Some operations may also be performed simultaneously or in parallel. In cases where an operation is said to be "based on" or "according to" another item or operation, this should be understood to imply that the operation is based at least partly on or according at least partly to the other item or operation. This should not be construed to imply that the operation is based solely or exclusively on, or solely or exclusively according to the item or operation.

All or part of any hardware element disclosed herein may readily be provided in an SoC, including a central processing unit (CPU) package. An SoC represents an integrated circuit (IC) that integrates components of a computer or other electronic system into a single chip. Thus, for example, client devices or server devices may be provided, in whole or in part, in an SoC. The SoC may contain digital, analog, mixed-signal, and radio frequency (RF) functions, all of which may be provided on a single chip substrate. Other embodiments may include a multichip module (MCM), with a plurality of chips located within a single electronic package and configured to interact closely with each other through the electronic package.

In a general sense, any suitably-configured circuit or processor can execute any type of instructions associated with the data to achieve the operations detailed herein. Any processor disclosed herein could transform an element or an article (for example, data) from one state or thing to another state or thing. Furthermore, the information being tracked, sent, received, or stored in a processor could be provided in any database, register, table, cache, queue, control list, or storage structure, based on particular needs and implementations, all of which could be referenced in any suitable timeframe. Any of the memory or storage elements disclosed herein, should be construed as being encompassed within the broad terms "memory" and "storage," as appropriate.

Computer program logic implementing all or part of the functionality described herein is embodied in various forms, including, but in no way limited to, a source code form, a computer executable form, machine instructions or microcode, programmable hardware, and various intermediate forms (for example, forms generated by an assembler, compiler, linker, or locator). In an example, source code includes a series of computer program instructions implemented in various programming languages, such as an object code, an assembly language, or a high-level language such as Open Computing Language (OpenCL), Formula Translator (FORTRAN), C, C++, JAVA, or Hypertext Markup Language (HTML) for use with various operating systems or operating environments, or in hardware description languages such as Spice, Verilog, and Very High Speed Integrated Circuit Hardware Description Language (VHDL). The source code may define and use various data structures and communication messages. The source code may be in a computer executable form (e.g., via an interpreter), or the source code may be converted (e.g., via a translator, assembler, or compiler) into a computer executable form, or converted to an intermediate form such as byte code. Where appropriate, any of the foregoing may be used to build or describe appropriate discrete or integrated circuits, whether sequential, combinatorial, state machines, or otherwise.

In one example embodiment, any number of electrical circuits of the FIGURES may be implemented on a board of an associated electronic device. The board can be a general circuit board that can hold various components of the internal electronic system of the electronic device and, further, provide connectors for other peripherals. Any suitable processor and memory can be suitably coupled to the board based on particular configuration needs, processing demands, and computing designs. Note that with the numerous examples provided herein, interaction may be described in terms of two, three, four, or more electrical components. However, this has been done for purposes of clarity and example only. It should be appreciated that the system can be consolidated or reconfigured in any suitable manner. Along similar design alternatives, any of the illustrated components, modules, and elements of the FIGURES may be combined in various possible configurations, all of which are within the broad scope of this specification.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 (pre-AIA) or paragraph (f) of the same section (post-AIA), as it exists on the date of the filing hereof unless the words "means for" or "steps for" are specifically used in the particular claims; and (b) does not intend, by any statement in the specification, to limit this disclosure in any way that is not otherwise expressly reflected in the appended claims.

Example Implementations

The following examples are provided by way of illustration.

Example 1 includes an electromagnetic wave launcher apparatus, comprising: an interface to an electromagnetic waveguide; a first launcher configured to launch a high-frequency electromagnetic signal onto a first cross-sectional portion of the waveguide; and a second launcher configured to launch a lower-frequency electromagnetic signal onto a second cross-sectional portion of the waveguide.

Example 2 includes the electromagnetic wave launcher apparatus of example 1, wherein the high-frequency electromagnetic signal has a minimum frequency of approximately 200 GHz.

Example 3 includes the electromagnetic wave launcher apparatus of example 1, wherein the high-frequency electromagnetic signal has a frequency in the range of approximately 300 GHz to approximately 1 THz.

Example 4 includes the electromagnetic wave launcher apparatus of example 1, wherein the low-frequency electromagnetic signal has a maximum frequency of approximately 200 GHz.

Example 5 includes the electromagnetic wave launcher apparatus of example 1, wherein the low-frequency electromagnetic signal has a maximum frequency of approximately 60 GHz.

Example 6 includes the electromagnetic wave launcher apparatus of example 1, wherein the first cross-sectional portion is rectangular and has dimensions of less than 200 μm×400 μm.

Example 7 includes the electromagnetic wave launcher apparatus of example 1, wherein the first cross-sectional portion is rectangular and has dimensions of less than 100 μm×400 μm.

Example 8 includes the electromagnetic wave launcher apparatus of example 1, wherein the second cross-sectional portion is rectangular and has dimensions of approximately 1.5 mm×3 mm.

Example 9 includes the electromagnetic wave launcher apparatus of example 1, wherein the second launcher is configured to launch the low-frequency electromagnetic wave orthogonal to the high-frequency electromagnetic wave.

Example 10 includes the electromagnetic wave launcher apparatus of example 1, wherein the first launcher is a vertical launcher and the second launcher is a horizontal launcher.

Example 11 includes the electromagnetic wave launcher apparatus of example 1, wherein at least one of the wave launchers is a patch launcher.

Example 12 includes the electromagnetic wave launcher apparatus of example 1, wherein at least one of the wave launchers is selected from the group consisting of a dipole launcher, tapered-slot launcher, or Vivaldi launcher.

Example 13 includes the electromagnetic wave launcher apparatus of any of examples 1-12, further comprising a plurality of high-frequency launchers.

Example 14 includes an electromagnetic wave guide, comprising: a high-permittivity core waveguide; a lower-permittivity cladding around the core waveguide; and a conductive shield around the cladding.

Example 15 includes the electromagnetic wave guide of example 14, wherein the core waveguide is disposed substantially non-concentric to the cladding.

Example 16 includes the electromagnetic wave guide of example 14, wherein the core waveguide is disposed along an edge of the cladding.

Example 17 includes the electromagnetic wave guide of example 14, wherein the core waveguide is rectangular, with dimensions in the range of approximately 100 μm to 1 mm.

Example 18 includes the electromagnetic wave guide of example 14, wherein the core waveguide has dimensions of less than or equal to approximately 200 μm×400 μm.

Example 19 includes the electromagnetic wave guide of example 14, wherein the core waveguide has dimensions of less than or equal to approximately 100 μm×400 μm.

Example 20 includes the electromagnetic wave guide of example 14, wherein the cladding is rectangular, with dimensions in the range of 1 mm to 5 mm.

Example 21 includes the electromagnetic wave guide of example 14, wherein the cladding has dimensions of less than or equal to approximately 1.5 mm×3 mm.

Example 22 includes the electromagnetic wave guide of example 14, wherein the high-permittivity core waveguide has a relative permittivity of approximately 3 to 20.

Example 23 includes the electromagnetic wave guide of example 14, wherein the lower-permittivity cladding has a relative permittivity of approximately 1.5 to 3.

Example 24 includes the electromagnetic wave guide of example 14, further comprising a plurality of core waveguides.

Example 25 includes an electromagnetic waveguide bundle comprising a plurality of electromagnetic waveguides of example 14, bundled into a waveguide assembly.

Example 26 includes a server rack, comprising: a chassis; a first server having a first launcher assembly, the first launcher assembly comprising a first launcher to launch a high-frequency electromagnetic signal, and a second launcher to launch a lower-frequency electromagnetic signal; a second server having a second launcher assembly, the second launcher assembly having a first launcher to launch a high-frequency electromagnetic signal, and a second launcher to launch a lower-frequency electromagnetic signal; and a dielectric waveguide having a high-permittivity core waveguide disposed to communicatively couple the first launcher of the first launcher assembly to the first launcher of the second launcher assembly, and a lower-permittivity cladding disposed to communicatively couple the second launcher of the first launcher assembly to the second launcher of the second launcher assembly.

Example 27 includes the server rack of example 26, wherein the core waveguide is not substantially concentric with the cladding.

What is claimed is:

1. An electromagnetic wave launcher apparatus, comprising:

an interface to an electromagnetic waveguide;

a first launcher configured to launch a millimeter-band electromagnetic signal onto a first cross-sectional portion of the electromagnetic waveguide; and a second launcher configured to launch a lower-frequency electromagnetic signal onto a second cross-sectional portion of the electromagnetic waveguide.

2. The electromagnetic wave launcher apparatus of claim 1, wherein the millimeter-band electromagnetic signal has a minimum frequency of approximately 200 gigahertz (GHz).

3. The electromagnetic wave launcher apparatus of claim 1, wherein the millimeter-band electromagnetic signal has a frequency in the range of approximately 300 GHz to approximately 1 terahertz (THz).

4. The electromagnetic wave launcher apparatus of claim 1, wherein the lower-frequency electromagnetic signal has a maximum frequency of approximately 200 GHz.

5. The electromagnetic wave launcher apparatus of claim 1, wherein the lower-frequency electromagnetic signal has a maximum frequency of approximately 60 GHz.

6. The electromagnetic wave launcher apparatus of claim 1, wherein the first cross-sectional portion is rectangular and has dimensions of less than 200 micrometers (μm)×400 μm.

7. The electromagnetic wave launcher apparatus of claim 1, wherein the first cross-sectional portion is rectangular and has dimensions of less than 100 μm×400 μm.

8. The electromagnetic wave launcher apparatus of claim 1, wherein the second cross-sectional portion is rectangular and has dimensions of approximately 1.5 millimeters (mm)×3 mm.

9. The electromagnetic wave launcher apparatus of claim 1, wherein the second launcher is configured to launch the lower-frequency electromagnetic signal orthogonal to the millimeter-band electromagnetic signal.

10. The electromagnetic wave launcher apparatus of claim 1, wherein the first launcher is a vertical launcher and the second launcher is a horizontal launcher.

11. The electromagnetic wave launcher apparatus of claim 1, wherein one of the first and second launchers is a patch launcher, and wherein the other one of the first and second launchers is selected from the group consisting of a dipole launcher, tapered-slot launcher, or Vivaldi launcher.

12. The electromagnetic wave launcher apparatus of claim 1, further comprising at least a third launcher.

13. A communication apparatus, comprising:

a mechanical interface to receive a dielectric waveguide;

a first launcher comprising circuitry and an interface to launch a first electromagnetic signal onto a first region of the dielectric waveguide, the first electromagnetic signal having a frequency in the range of approximately 300 GHz to 1 THz; and a second launcher comprising circuitry and an interface to launch a second electromagnetic signal onto a second region of the dielectric waveguide, the second electromagnetic signal having a maximum frequency below 300 GHz.

14. The communication apparatus of claim 13, wherein the second launcher is configured to launch the second electromagnetic signal orthogonal to the first electromagnetic signal.

15. The communication apparatus of claim 13, wherein the first launcher is a vertical launcher and the second launcher is a horizontal launcher.

16. The communication apparatus of claim 13, wherein one of the first and second launchers is a patch launcher, and wherein the other one of the first and second launchers is selected from the group consisting of a dipole launcher, tapered-slot launcher, or Vivaldi launcher.

17. The communication apparatus of claim 13, wherein the maximum frequency of the second electromagnetic signal is approximately 200 GHz.

18. The communication apparatus of claim 13, wherein the maximum frequency of the second electromagnetic signal is approximately 60 GHz.

19. A server rack, comprising:

a chassis;

a first server having a first launcher assembly, the first launcher assembly comprising a first launcher to launch a first high-frequency electromagnetic signal, and a second launcher to launch a second lower-frequency electromagnetic signal, wherein the first high-frequency electromagnetic signal is a millimeter-band signal;

a second server having a second launcher assembly, the second launcher assembly having a third launcher to launch a third high-frequency electromagnetic signal, and a fourth launcher to launch a fourth lower-frequency electromagnetic signal; and a dielectric waveguide having a high-permittivity core waveguide disposed to communicatively couple the first launcher to the third launcher, and a lower-permittivity cladding disposed to communicatively couple the second launcher to the fourth launcher.

20. The server rack of claim 19, wherein the core waveguide is not substantially concentric with the cladding.

* * * * *